US011085254B2

(12) United States Patent
Odegard et al.

(10) Patent No.: US 11,085,254 B2
(45) Date of Patent: Aug. 10, 2021

(54) BIT BREAKER TECHNOLOGY

(71) Applicant: Falcon Tools, LLC, Fargo, ND (US)

(72) Inventors: Bradley A. Odegard, Fargo, ND (US); Christopher J. Kutzer, Fergus Falls, MN (US)

(73) Assignee: FALCON TOOLS, LLC, Fargo, ND (US)

( * ) Notice: Subject to any disclaimer, the term of this patent is extended or adjusted under 35 U.S.C. 154(b) by 190 days.

(21) Appl. No.: 16/198,374

(22) Filed: Nov. 21, 2018

(65) Prior Publication Data

US 2019/0186218 A1 Jun. 20, 2019

Related U.S. Application Data

(60) Provisional application No. 62/607,545, filed on Dec. 19, 2017.

(51) Int. Cl.
*E21B 19/18* (2006.01)

(52) U.S. Cl.
CPC ..... *E21B 19/18* (2013.01)

(58) Field of Classification Search
None
See application file for complete search history.

(56) References Cited

U.S. PATENT DOCUMENTS 1,690,007 A 10/1928 Greve
1,798,296 A 3/1931 Yerkes et al.
2,528,814 A 11/1950 Boyer
2,633,045 A 3/1953 Lurie
2,637,236 A 5/1953 Vergnani et al.
2,656,751 A 10/1953 Johnson et al.
3,463,247 A * 8/1969 Klein ..... E21B 19/167 173/164
3,500,708 A 3/1970 Wilson
3,554,298 A * 1/1971 Klein ..... E21B 19/167 173/164
3,582,158 A 6/1971 Hammon
3,739,434 A 6/1973 Wheeler
(Continued)

OTHER PUBLICATIONS

International Patent Application No. PCT/US2018/062274, International Search Report and Written Opinion dated Mar. 29, 2019, 15 pages.

(Continued)

*Primary Examiner* — Kipp C Wallace
(74) *Attorney, Agent, or Firm* — Fredrikson & Byron, P.A.

(57) ABSTRACT

The invention provides a bit breaker comprising a plate that bounds a pipe slot. The bit breaker has two jaws that are at least generally parallel and that respectively define two working surfaces located on opposite sides of the pipe slot. The jaws are each mounted removably to the plate. In some embodiments, the invention is an assembly that further includes a pipe, tool section, tool or pipe joint received in the pipe slot. The pipe, tool section, tool or pipe joint has formed therein two crosswise grooves located on opposite sides of the pipe, tool section, tool or pipe joint. In some embodiments, the plate defines two fixed arms and a fixed base leg, with the two jaws mounted respectively against the two fixed arms. The bit breaker can have an adjustable arm such that the pipe slot can be surrounded about 360 degrees by the bit breaker.

25 Claims, 37 Drawing Sheets

(56) References Cited

U.S. PATENT DOCUMENTS

| | | | | |
|---|---|---|---|---|
| 3,957,113 | A | 5/1976 | Jones et al. | |
| 4,057,887 | A | 11/1977 | Jones et al. | |
| 4,352,399 | A | 10/1982 | Davis | |
| 4,445,402 | A | 5/1984 | Farr et al. | |
| 4,458,562 | A | 7/1984 | Jackson | |
| 4,495,840 | A * | 1/1985 | Freitag | E21B 19/18 175/315 |
| 4,576,067 | A | 3/1986 | Buck | |
| 4,709,599 | A | 12/1987 | Buck | |
| 4,747,588 | A | 5/1988 | Dillhoff | |
| 4,811,635 | A | 3/1989 | Falgout | |
| 5,040,438 | A | 8/1991 | Rousseau | |
| 5,060,542 | A * | 10/1991 | Hauk | E21B 19/163 81/57.34 |
| 5,386,746 | A | 2/1995 | Hauk | |
| 5,727,432 | A | 3/1998 | Burns et al. | |
| 5,791,206 | A | 8/1998 | Daigle et al. | |
| 5,823,074 | A | 10/1998 | Ahlstone | |
| 5,868,045 | A | 2/1999 | Hauk | |
| 5,911,796 | A | 6/1999 | Buck | |
| 5,931,231 | A * | 8/1999 | Mock | E21B 19/163 166/377 |
| 6,000,686 | A * | 12/1999 | Yates | B25B 5/12 269/143 |
| 6,152,435 | A | 11/2000 | Snell | |
| 6,311,789 | B1 * | 11/2001 | Saxman | E21B 19/18 175/57 |
| 6,505,531 | B2 | 1/2003 | Stogner | |
| 6,637,296 | B1 | 10/2003 | Dagenais et al. | |
| 7,226,047 | B1 | 6/2007 | Beauchamp | |
| 7,231,984 | B2 | 6/2007 | Jaensch | |
| 7,748,297 | B2 | 7/2010 | Belik | |
| 7,997,167 | B2 * | 8/2011 | Kruse | E21B 19/161 81/57.34 |
| 8,042,433 | B2 | 10/2011 | Chu | |
| 8,393,251 | B2 | 3/2013 | Dagenais et al. | |
| 8,550,180 | B2 | 10/2013 | Kahra | |
| 9,181,766 | B2 | 11/2015 | Leahy et al. | |
| 9,546,526 | B2 | 1/2017 | Li et al. | |
| 2002/0033277 | A1 | 3/2002 | Mosing et al. | |
| 2003/0182761 | A1 | 10/2003 | Kidd | |
| 2005/0011312 | A1 | 1/2005 | Mardian | |
| 2005/0188793 | A1 | 9/2005 | Cherry | |
| 2008/0022811 | A1 | 1/2008 | Kathan | |
| 2010/0065455 | A1 * | 3/2010 | Weaver | E21B 10/00 206/349 |
| 2010/0193247 | A1 | 8/2010 | Riddle et al. | |
| 2014/0327201 | A1 | 11/2014 | Marple et al. | |
| 2015/0218897 | A1 * | 8/2015 | Jost | E21B 17/04 166/380 |
| 2015/0275598 | A1 * | 10/2015 | Webre | E21B 19/164 81/57.11 |

OTHER PUBLICATIONS

"Bit Breaker for 8 ½ PDC Bit," Longyue, Retrieved online from <http://www.triconerockbit.com/sale-10603151-bit-breaker-for-8-1-2-pdc-bit.html>, on Mar. 13, 2019, 5 pages. Believed to have been on sale and/or in public use prior to the filing date of Applicant's provisional patent application.

"Tools—Pipe Clamp: Kwik Klamp," J&K Tool Company, Retrieved online from <https://www.jktool.com/tools/kwik-klamps/>, on Mar. 11, 2019, 2 pages. Believed to have been on sale and/or in public use prior to the filing date of Applicant's provisional patent application.

"API Thread Connection Thread DTH Drill Pipe for Water Well Drilling Machine," SOLLROC Drilling Tools, Retrieved online from <https://www.dth-tools.com/sale-10187394-api-thread-connection-thread-dth-drill-pipe-for-water-well-drilling-machine.html>, on Mar. 11, 2019, 4 pages. Believed to have been on sale and/or in public use prior to the filing date of Applicant's provisional patent application.

"High Thermal Stability DTH Drill Pipe 5.5" F Thread 50mm 60mm OD for Oil Drilling," from search results for Drill Pipe Drilling Equipment on Bushorchimp.com, Retrieved online from <http://www.bushorchimp.com/s-drill-pipe-drilling-equipment>, on Mar. 11, 2019, 3 pages. Believed to have been on sale and/or in public use prior to the filing date of Applicant's provisional patent application.

"API Reg Thread DTH Drilling Pipes DTH Drilling Rods DTH Drilling Tubes," SOLLROC Drilling Tools, Retrieved online from <https://www.dth-tools.com/sale-10187119-api-reg-thread-dth-drilling-pipes-dth-drilling-rods-dth-drilling-tubes.html>, on Mar. 11, 2019, 4 pages. Believed to have been on sale and/or in public use prior to the filing date of Applicant's provisional patent application.

"Water well drilling 6 ¼" steel tooth tricone bit breaker," Hejian Deris Petroleum Drilling Equipment Co., Ltd., Retrieved online from <https://hjdrs.en.alibaba.com/product/60066058253-800347067/water_well_drilling_6_1_4_steel_tooth_tricone_bit_breaker.html?spm=a2700.icbuShop.41413.27.69b76487YhUg87>, on Mar. 11, 2019, 6 pages. Believed to have been on sale and/or in public use prior to the filing date of Applicant's provisional patent application.

"PDC Drill Bits," Infinity Tool Mfg., Retrieved online from <https://www.infinitytoolmfg.com/products/pdc-drill-bits/>, on Jun. 10, 2019, 3 pages.

"PDC Drill Bits," Infinity Tool Mfg., Retrieved online from Internet Wayback Archive Machine, <https://web.archive.org/web/20161030113142/https://www.infinitytoolmfg.com/products/pdc-drill-bits/>, dated Oct. 30, 2016, 3 pages.

"Fixed Cutter Bits," Varel International Energy Services, Inc., Retrieved online from <http://www.vareloilandgas.com/index.php/en/fixed-cutter-bits>, on Jun. 10, 2019, 14 pages.

"Fixed Cutter Bits," Varel International Energy Services, Inc., Retrieved online from Internet Wayback Archive Machine <http://www.vareloilandgas.com/index.php/en/fixed-cutter-bits>, dated Nov. 13, 2016, 12 pages.

U.S. Appl. No. 16/198,399, Non-Final Office Action dated Mar. 14, 2019, 11 pages.

U.S. Appl. No. 16/198,399, Response to Non-Final Office Action filed Jun. 6, 2019, 12 pages.

"Kwik Klamps (Well Pipe Clamps)," America West Drilling Supply, Retrieved online from <https://americawestdrillingsupply.com/WellPipeClamps.asp>, on Mar. 11, 2019, 10 pages.

"Kwik Klamps (Well Pipe Clamps)," America West Drilling Supply, Retrieved online from Internet Wayback Archive Machine, <https://web.archive.org/web/20171128065320/https://americawestdrillingsupply.com/WellPipeClamps.asp>, dated Nov. 28, 2017, 4 pages.

"Tools—Pipe Clamp: Kwik Klamp," J&K Tool Company, Retrieved online from <https://www.jktool.com/tools/kwik-klamps/>, on Mar. 11, 2019, 2 pages.

"Tools—Pipe Clamp: Kwik Klamp," J&K Tool Company, Retrieved online from Internet Wayback Archive Machine, <https://web.archive.org/web/20171124125104/http:/www.jktool.com/tools/kwik-klamps>, dated Nov. 24, 2017, 2 pages.

"API Thread Connection Thread DTH Drill Pipe for Water Well Drilling Machine," SOLLROC Drilling Tools, Retrieved online from <https://www.dth-tools.com/sale-10187394-api-thread-connection-thread-dth-drill-pipe-for-water-well-drilling-machine.html>, on Mar. 11, 2019, 4 pages.

"High Thermal Stability DTH Drill Pipe 5.5" F Thread 50mm 60mm OD for Oil Drilling," from search results for Drill Pipe Drilling Equipment on Bushorchimp.com, Retrieved online from <http://www.bushorchimp.com/s-drill-pipe-drilling-equipment>, on Mar. 11, 2019, 3 pages.

"API Reg Thread DTH Drilling Pipes DTH Drilling Rods DTH Drilling Tubes," SOLLROC Drilling Tools, Retrieved online from <https://www.dth-tools.com/sale-10187119-api-reg-thread-dth-drilling-pipes-dth-drilling-rods-dth-drilling-tubes.html>, on Mar. 11, 2019, 4 pages.

"Bit Breaker," Schlumberger Oilfield Glossary, Retrieved online from <https://www.glossary.oilfield.slb.com/en/Terms/b/bit_breaker.aspx>, on Mar. 11, 2019, 1 page.

"Bit Breaker," Schlumberger Oilfield Glossary, Retrieved online from Internet Wayback Archive Machine, <https://web.archive.org/web/20170629000508/http://www.glossary.oilfield.slb.com/en/Terms/b/bit_breaker.aspx>, dated Jun. 29, 2017, 2 pages.

(56) References Cited

OTHER PUBLICATIONS

"Bit Breaker," Janki Oil Tools, Retrieved online from <http://www.jankioiltools.com/bit-breaker.php>, on Mar. 11, 2019, 2 pages.
"Bit Breaker," Janki Oil Tools, Retrieved online from Internet Wayback Archive Machine, <https://web.archive.org/web/20170427162001/http://jankioiltools.com/bit-breaker.php>, dated Apr. 27, 2017, 2 pages.
"Water well drilling 6 ¼" steel tooth tricone bit breaker," Hejian Deris Petroleum Drilling Equipment Co., Ltd., Retrieved online from <https://hjdrs.en.alibaba.com/product/60066058253-800347067/water_well_drilling_6_1_4_steel_tooth_tricone_bit_breaker.html?spm=a2700.icbuShop.41413.27.69b76487YhUg87>, on Mar. 11, 2019, 6 pages.
Odegard et al., Unpublished U.S. Appl. No. 16/198,399, entitled Moveable Jaw Bit Breaker Technology, filed Nov. 21, 2018, 76 pages (including 37 pages of formalized replacement drawings filed Feb. 5, 2019).
"Bit Breaker for 8 ½ PDC Bit," Longyue, Retrieved online from <http://www.triconerockbit.com/sale-10603151-bit-breaker-for-8-1-2-pdc-bit.html>, on Mar. 13, 2019, 5 pages.
"Bit Breaker for 8 ½ PDC Bit," Longyue, Retrieved online from Internet Wayback Archive Machine, <https://web.archive.org/web/20180528083856/http://www.triconerockbit.com/sale-10603151-bit-breaker-for-8-1-2-pdc-bit.html>, dated May 28, 2018, 1 page.

* cited by examiner

BIT BREAKER TECHNOLOGY

CROSS REFERENCE

This application claims the benefit of U.S. Provisional Patent Application No. 62/607,545, filed Dec. 19, 2017, the entire contents of which are incorporated herein by reference.

FIELD OF THE INVENTION

The present invention relates to a bit breaker. More specifically, the present invention provides a bit breaker having a plate that bounds a pipe slot. In addition, the invention provides an assembly that further includes a pipe, tool section, tool or pipe joint received in the pipe slot of the bit breaker.

BACKGROUND OF THE INVENTION

Various styles of bit breakers are known. Bit breakers are commonly used in the oil and gas industries for connecting and disconnecting the joints between adjacent lengths of pipe and/or a drill bit or other tool. In many cases, each joint is defined by an upper component (e.g., an upper length of pipe) connected removably to a lower component (e.g., a lower length of pipe) by threading. Typically, the upper component is rotated in a clockwise direction to connect it to the lower component (and thereby make the joint) and in a counterclockwise direction to break (or loosen) the joint.

With certain conventional bit breakers, one or more working surfaces are particularly vulnerable to being deformed after repeated use. For example, when a pipe is rotated such that surfaces and/or edges of the flat-bottom grooves in the pipe apply force to the pipe slot working surfaces of a conventional bit breaker, the metal adjacent those working surfaces becomes deformed (e.g., gets compressed and/or swells). The resulting deformation is sometimes referred to as a "mushroom effect." This type of deformation can eventually render a bit breaker useless. As a result of these and other design limitations, some conventional bit breakers have longevity problems, reliability problems, or both.

It would be desirable to provide a bit breaker that overcomes these disadvantages and/or other limitation of conventional bit breakers.

SUMMARY OF THE INVENTION

Certain embodiments of the present invention provide a bit breaker comprising a generally flat plate that bounds a generally rectangular pipe slot. The bit breaker further comprises an adjustable arm having a closed position and an open position. When the adjustable arm is in its closed position, the pipe slot is surrounded about 360 degrees by the bit breaker. When the adjustable arm is in its open position, the pipe slot has an open side that enables the bit breaker to be removed from a pipe, tool section, tool or pipe joint by moving the bit breaker laterally relative to such a pipe, tool section, tool or pipe joint. The bit breaker has two jaws that that respectively define two flat working surfaces located on opposite sides of the pipe slot and optionally are at least generally parallel to each other. The jaws are each mounted removably to the plate so as to be removable from the plate when damaged and thereafter replaced with two new jaws.

In some embodiments, the invention provides an assembly of a bit breaker and a pipe, tool section, tool or pipe joint. The pipe, tool section, tool or pipe joint has formed therein two crosswise flat-bottom grooves located on opposite sides of the pipe, tool section, tool or pipe joint. The bit breaker comprises a generally flat plate that bounds a generally rectangular pipe slot. The pipe, tool section, tool or pipe joint is received in the pipe slot. The bit breaker further comprises an adjustable arm having a closed position and an open position. When the arm is in its closed position, the pipe slot is surrounded about 360 degrees by the bit breaker. When the arm is in its open position, the pipe slot has an open side that enables the bit breaker to be removed from the pipe, tool section, tool or pipe joint by moving the bit breaker laterally relative to the pipe, tool section, tool or pipe joint. The bit breaker has two that respectively define two flat working surfaces located on opposite sides of the pipe slot and optionally are generally parallel to each other. The two jaws are received respectively in the two flat-bottom grooves such that the two flat working surfaces of the two jaws are generally parallel to, and bear against, the two flat bottoms of the two flat-bottom grooves. The two jaws are each mounted removably to the plate so as to be removable from the plate when damaged and thereafter replaced with two new jaws.

In certain embodiments, the invention provides a bit breaker comprising a generally flat plate that defines two fixed arms and a fixed base leg. The two fixed arms project respectively from opposed ends of the fixed base leg. The two fixed arms have two respective free ends. The bit breaker has a generally rectangular pipe slot located between the two fixed arms of the plate. The bit breaker includes a jaw mounted to a desired one of the two fixed arms. The jaw defines a working surface located on a side of the pipe slot. The jaw is mounted to the desired one of the two fixed arms so as to be removable therefrom when damaged and thereafter replaced with a new jaw. In some of the present embodiments, the bit breaker includes a second jaw, which is mounted to a second one of the two fixed arms. In such cases, the second jaw defines a working surface located on a side of the pipe slot such that the two jaws are located on opposite sides of the pipe slot. When provided, the second jaw is mounted to the second one of the two fixed arms so as to be removable therefrom when damaged and thereafter replaced with a new jaw.

In some embodiments, the invention provides a bit breaker comprising a generally flat plate that bounds a pipe slot. Preferably, the bit breaker has two jaws that define two working surfaces located on opposite sides of the pipe slot. In the present embodiments, the two jaws are configured to move relative to the plate.

BRIEF DESCRIPTION OF THE DRAWINGS

The following drawings are illustrative of particular embodiments of the present invention and therefore do not limit the scope of the invention. The drawings are not necessarily to scale and are intended for use in conjunction with the explanations in the following detailed description. Embodiments of the present invention will hereinafter be described in conjunction with the appended drawings, wherein like numerals denote like elements.

DETAILED DESCRIPTION OF VARIOUS EMBODIMENTS

Figure 1:
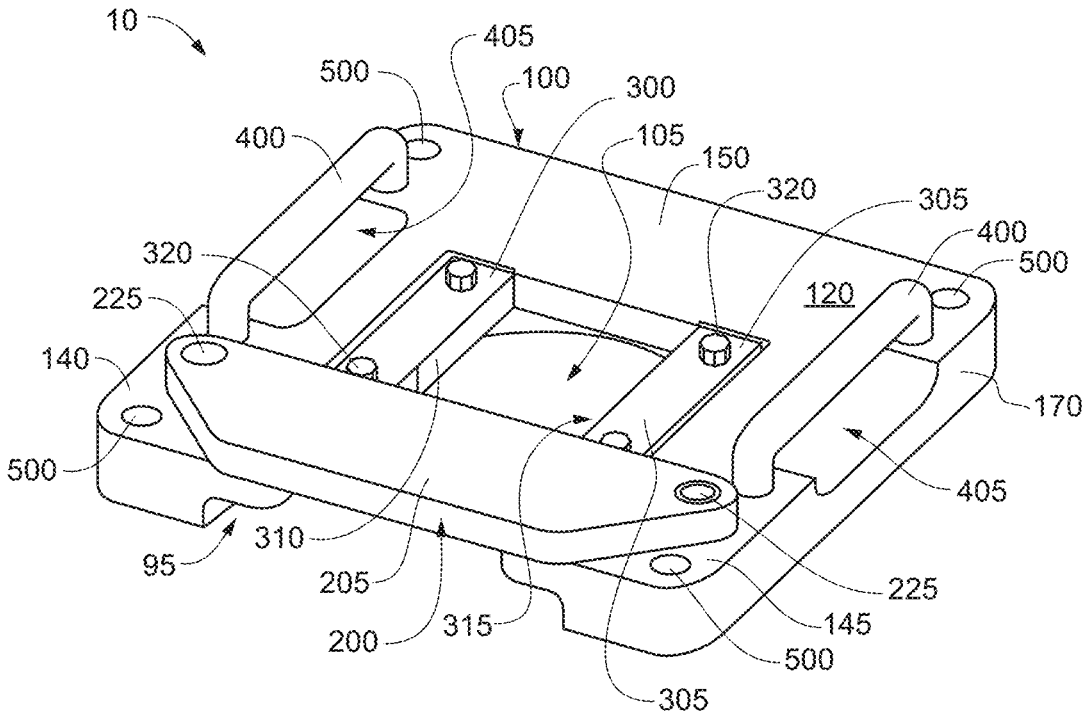
FIG. 1 is a top perspective view of a bit breaker in accordance with certain embodiments of the present disclosure wherein a pair of stationary, replaceable jaws is mounted to a plate of the bit breaker.

The following detailed description is to be read with reference to the drawings, in which like elements in different drawings have like reference numerals. The following detailed description is exemplary in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the examples provided herein have suitable alternatives that fall within the scope of the invention.

Figure 17:
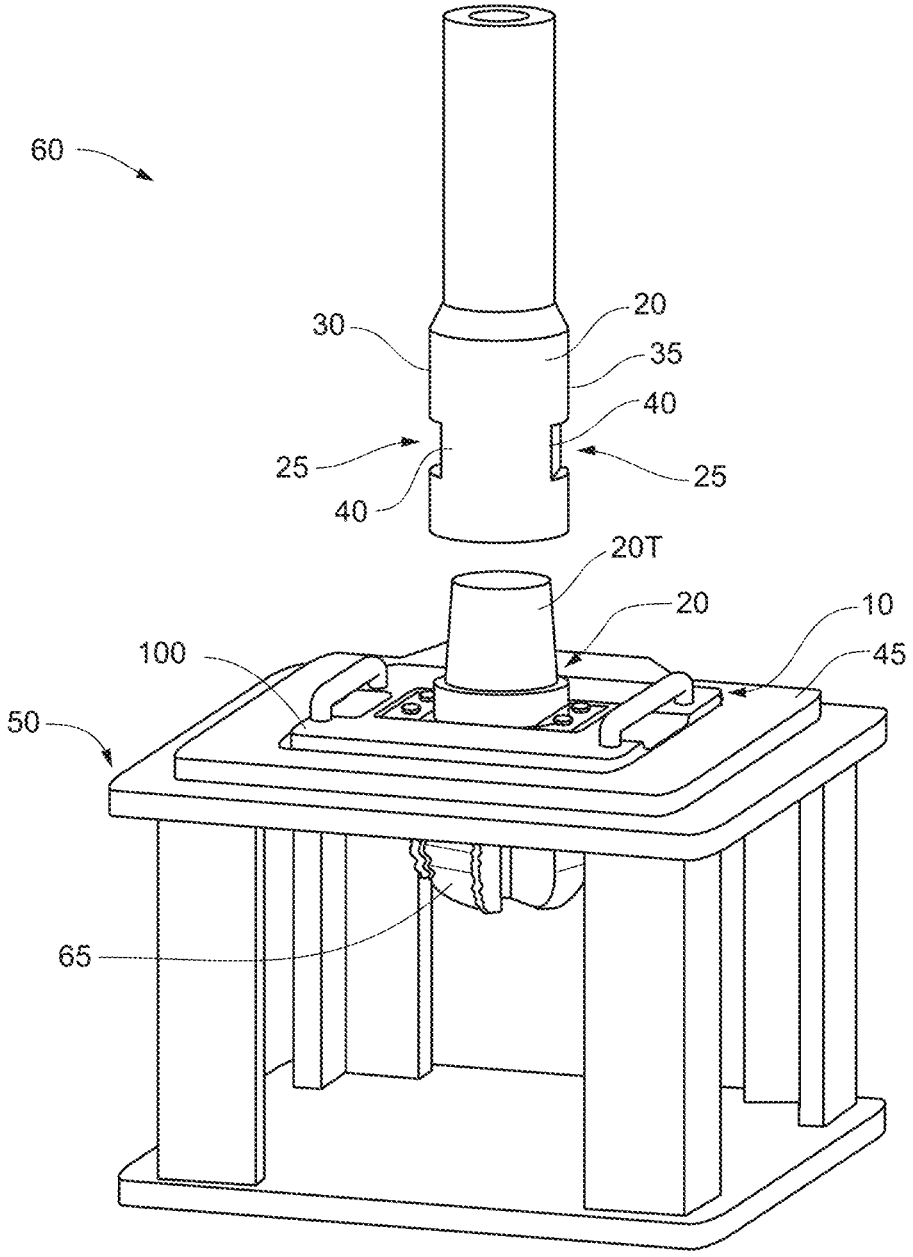
FIG. 17 is an in-use perspective view of a bit breaker of the present disclosure mounted on a table, with a drill stem received in the pipe slot of the bit breaker.

Referring to the drawings, and in particular FIG. 1, there is shown a bit breaker in accordance with certain preferred embodiments of the present disclosure generally represented by reference numeral 10. The illustrated bit breaker 10 is configured for use in making or loosening (or "unmaking," or "relieving," or "separating") a threaded joint, such as a pipe joint having two components threaded together. As will be appreciated by those of skill in the present art, a first component of the joint has an externally threaded male section 20T (see FIG. 17), while a second component of the joint has an internally threaded female section. In FIG. 17, the illustrated lower component 20 of the joint has the externally threaded male section 20T, while the upper component 20 of the joint has the internally threaded female section. This arrangement can, of course, be reversed (i.e., the internally threaded female section can be on the lower component while the externally threaded male section is on the upper component). Moreover, the bit breaker can be used when the two components of the joint are oriented horizontally, rather than vertically as shown in FIG. 17, or at various other angles.

Figure 18A:
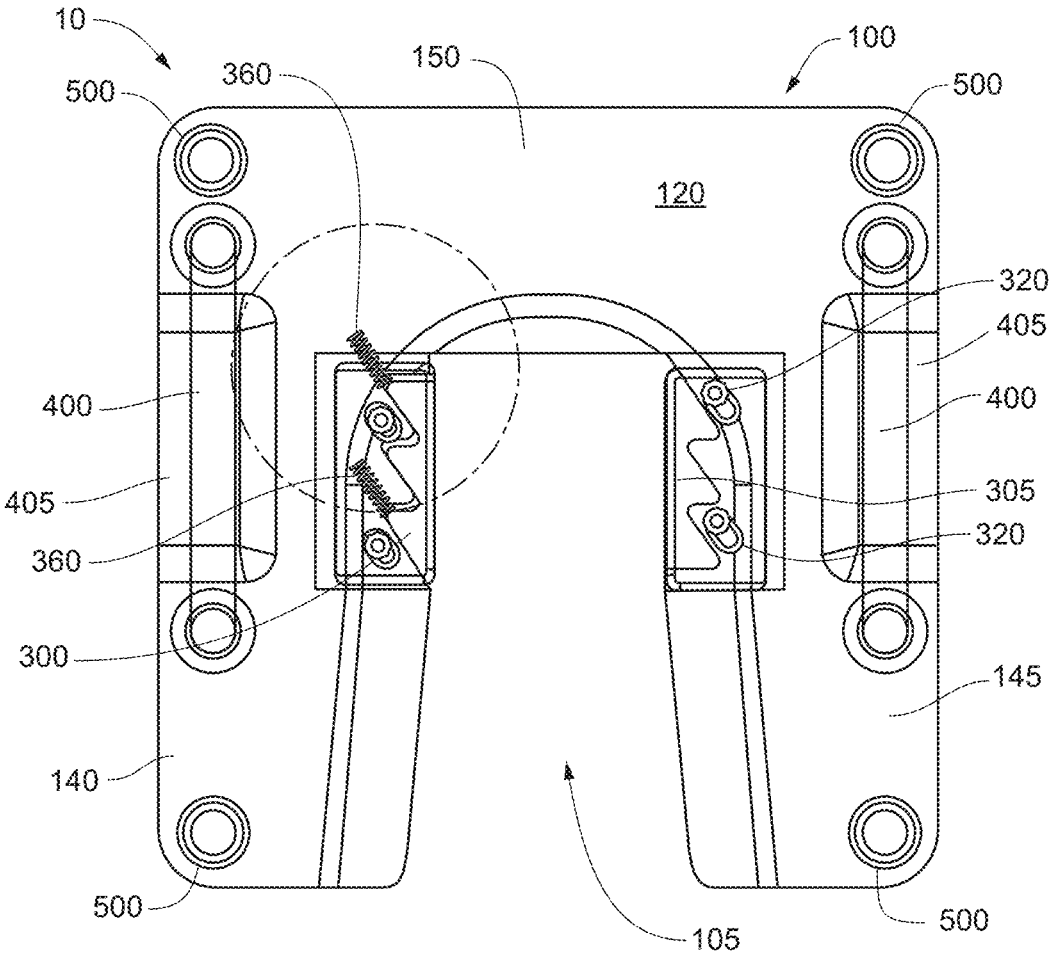
FIG. 18A is a schematic top view of a bit breaker in accordance with certain embodiments of the present disclosure springs configured to apply force to movable jaws of the bit breaker.
Figure 18B:
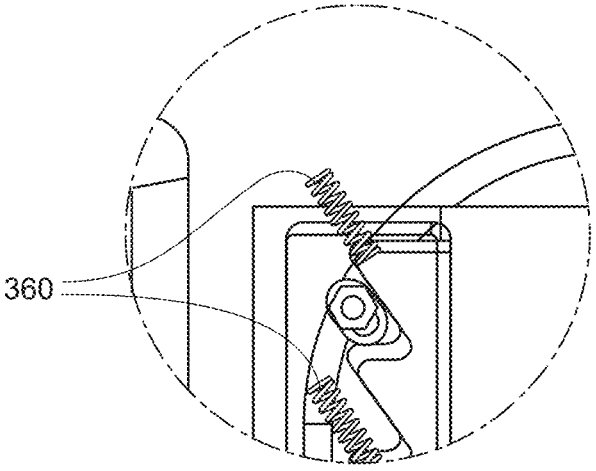
FIG. 18B is a broken-away detailed view of a portion of the bit breaker FIG. 18A, schematically showing the springs mounted in a plate of the bit breaker.
Figure 32:
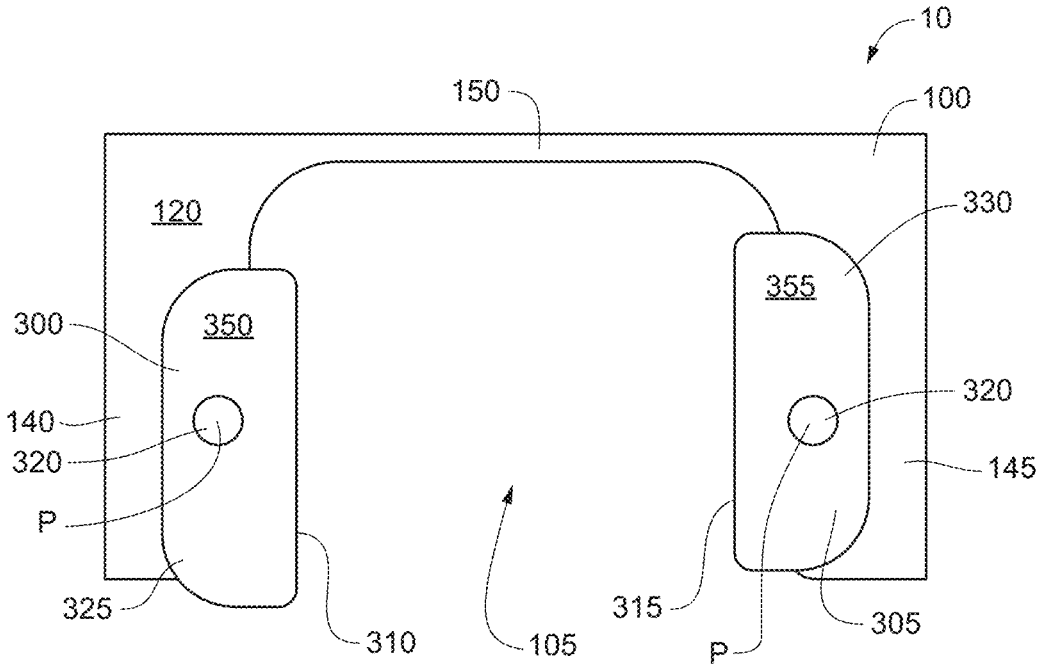
FIG. 32 is a top view of a bit breaker in accordance with still another embodiment of the present disclosure
Figure 33:
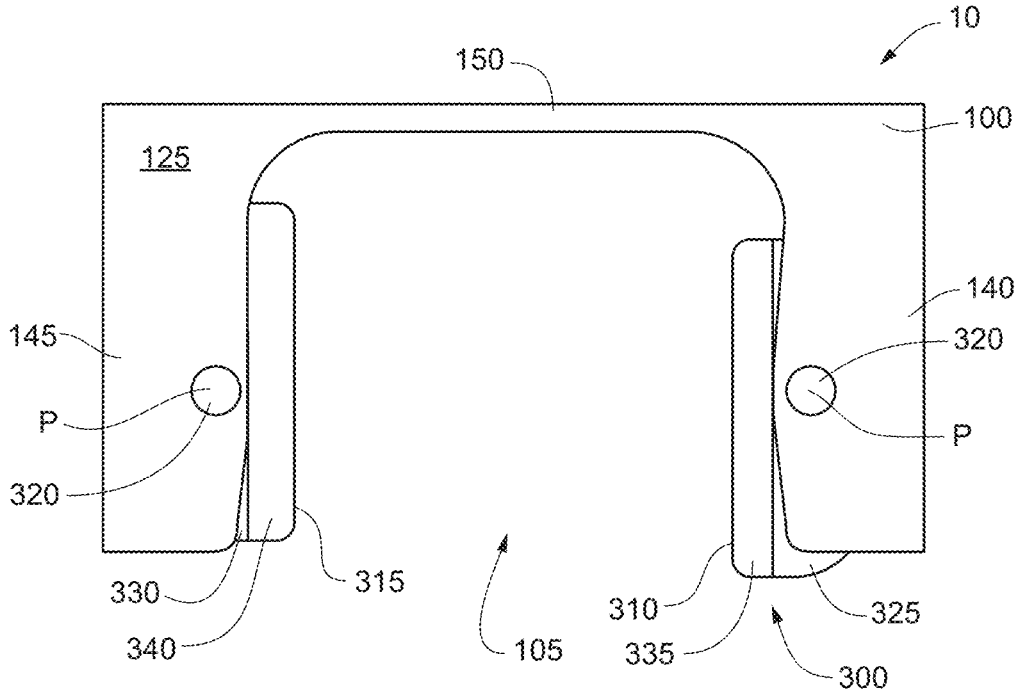
FIG. 33 is a bottom view of the bit breaker of FIG. 32.
Figure 34:
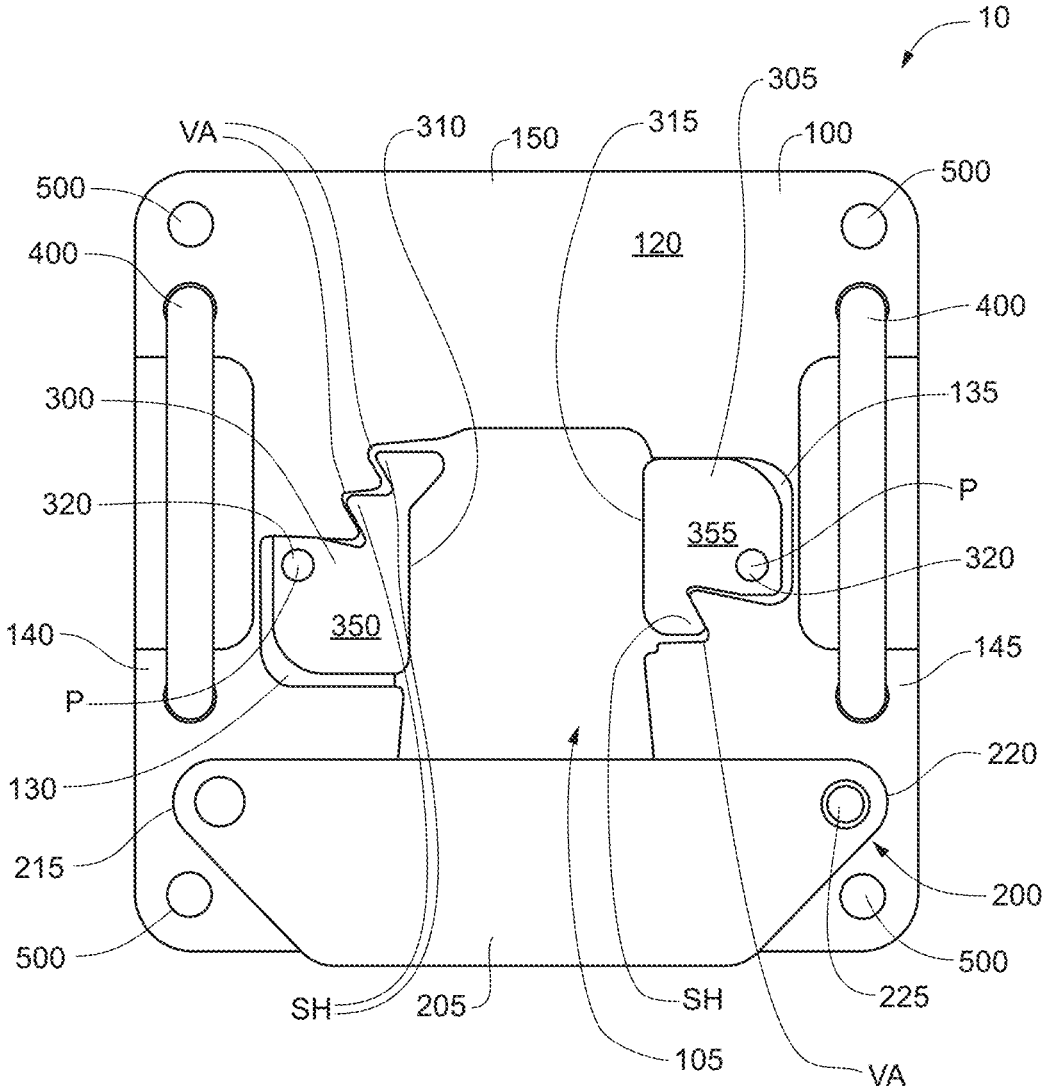
FIG. 34 is a top view of a bit breaker in accordance with yet another embodiment of the present disclosure
Figure 35:
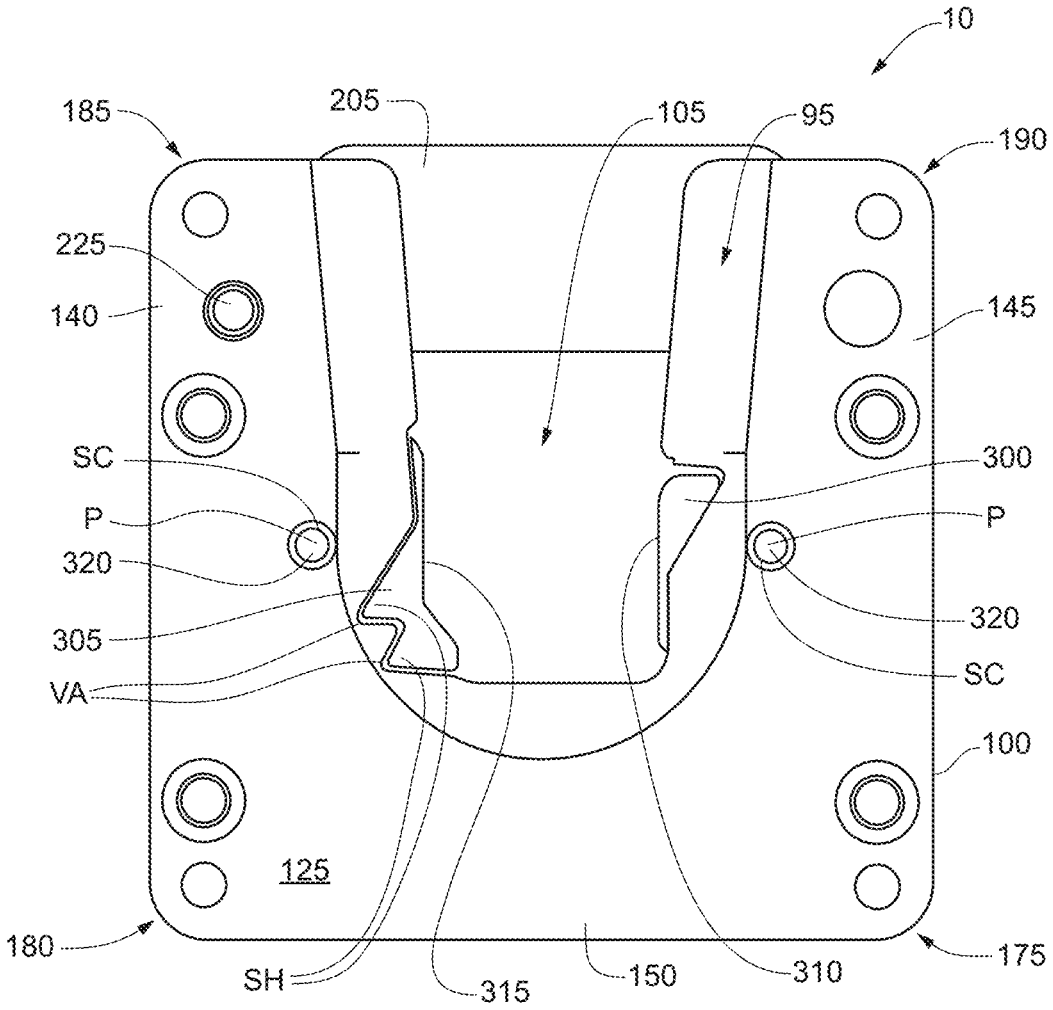
FIG. 35 is a bottom view of the bit breaker of FIG. 34.
Figure 36:
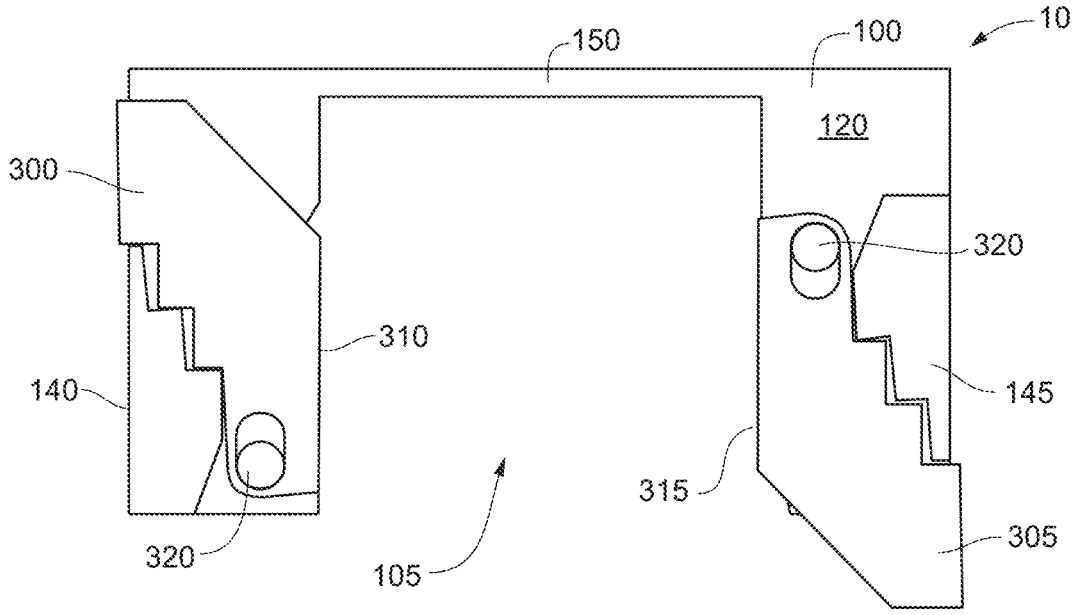
FIG. 36 is a top view of a bit breaker in accordance with a further embodiment of the present disclosure
Figure 37:
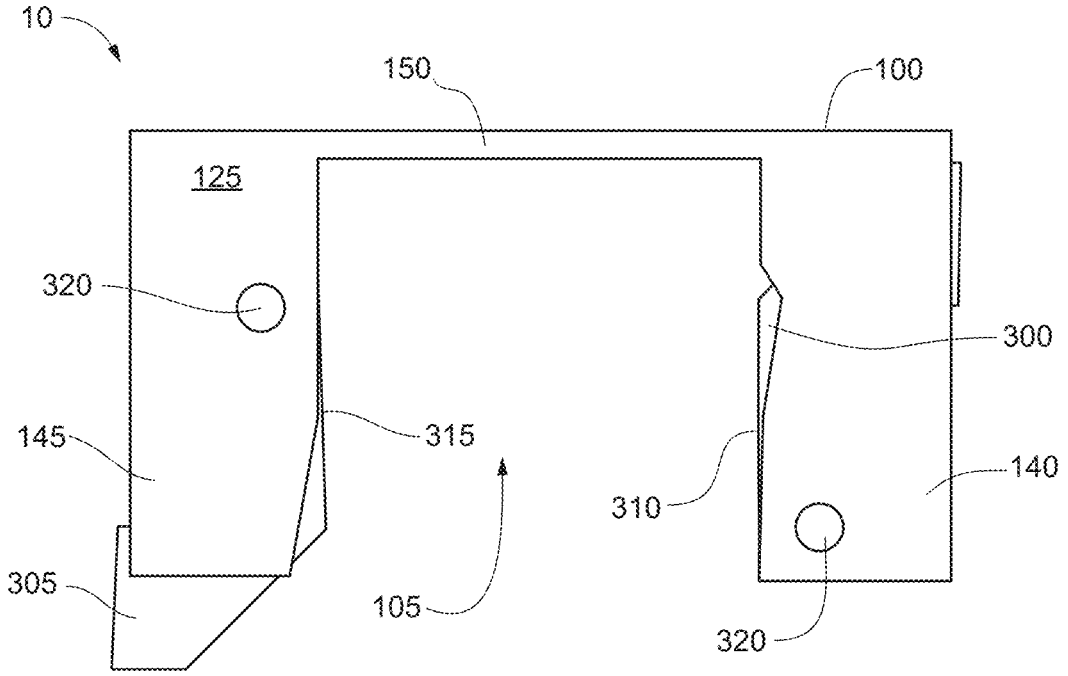
FIG. 37 is a bottom view of the bit breaker of FIG. 36.

The bit breaker shown in FIG. 17 can be of the type shown in FIGS. 1-8, or of the type shown in FIGS. 9-15, or of the type shown in FIGS. 18A-18B, or of the type shown in FIGS. 1-29, or of the type shown in FIGS. 32-33, or of the type shown in FIGS. 34-35, or of the type shown in FIGS. 36-37.

In certain preferred embodiments, the threaded joint is a joint between two sections of a vertically extending string (e.g., a pipe string or tool string). In such cases, the string (or at least a major length thereof) preferably has a longitudinal axis extending vertically or at least generally vertically. During use, the string (or at least a part thereof, optionally a major length thereof) may be located in an elongated hole in the earth (and thus disposed underground). The hole will commonly be vertical or at least generally vertical, although a variety of other downward angles may be used.

In some cases, the threaded joint is between two components of a tool string (e.g., a drill string) or a pipe string. Thus, the joint comprises a threaded connection between two pipes, between a tool section and a tool pipe (e.g., between a drill bit and a drill pipe), between a tool pipe and a pipe, or between a tool section and a pipe. When the joint involves a tool section, it may be a drill bit or any other tool, such as a mudding tool or a fracking tool. Thus, while the present apparatus is referred to herein as bit breaker, it is to be understood that it can be used to make or loosen various types of threaded joints (e.g., pipe joints), not just those joints that involve a drill bit.

The bit breaker includes a plate and a jaw that is mounted to the plate. In many cases, the bit breaker 10 includes a plate 100 and two jaws 300, 305 that are mounted to the plate 100. Thus, the bit breaker 10 generally has one or more jaws 300, 305. While some sections of the present disclosure focus on embodiments where the bit breaker has two jaws, it is to be understood that any feature, component, or aspect described in such sections as being provided in pairs can alternatively be provided as a single feature (e.g., for embodiments where the bit breaker has only a single replaceable and/or moveable jaw).

Preferably, the plate 100 is a generally flat plate having opposed top 120 and bottom 125 planar faces. The top 120 and bottom 125 faces of the plate can optionally be generally parallel to each other. If desired, more than 50% of the area of the top face 120 can be parallel to more than 50% of the area of the bottom face 125. This, however, is not required.

Figure 2:
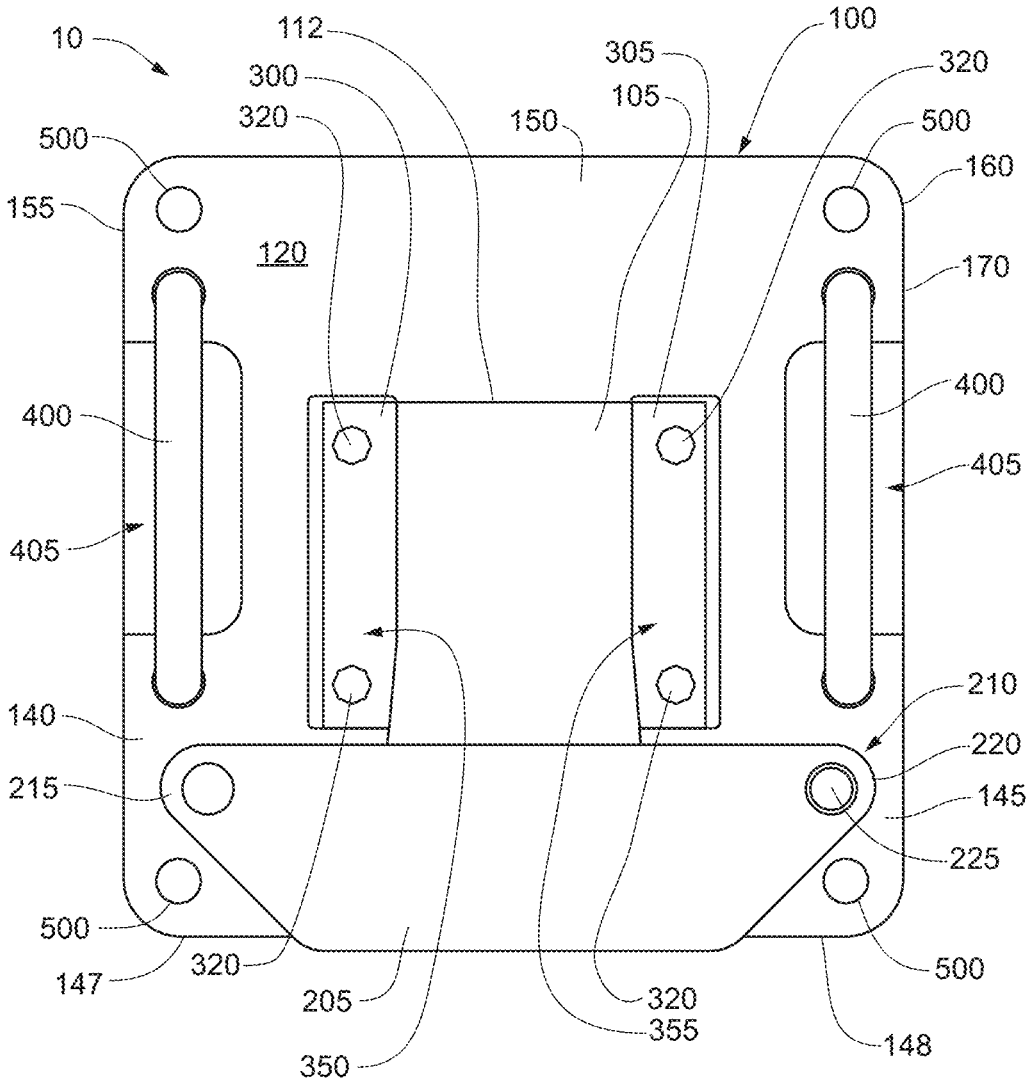
FIG. 2 is a top view of the bit breaker of FIG. 1.

The bit breaker 10 has (e.g., the plate 100 preferably bounds) a pipe slot 105 that is configured to receive a pipe, tool section, tool or pipe joint 20 therein. The pipe slot 105 can optionally be generally rectangular, e.g., it can have a generally squared-off back end (as shown in FIGS. 2, 8, 10, and 19A) or it can have a generally rounded-off (e.g., semicircular) back end, as is known from certain conventional bit breaker designs. Referring to FIG. 2, the back end of the pipe slot 105 is the end shown furthest to the top of the drawing.

In preferred embodiments, the bit breaker 10 is configured for use with a pipe, tool section, tool or pipe joint 20 that has two crosswise flat-bottom grooves 25 formed therein on opposite sides 30, 35 of the pipe, tool section, tool or pipe joint 20. The two flat-bottom grooves are channels that extend along axes that are crosswise (e.g., orthogonal) to a cylinder axis of the pipe, tool section, tool or pipe joint. The axes of the two grooves preferably are parallel to each other. Reference is made to FIG. 17. Here, the bit breaker 10 is configured to support the pipe, tool section, tool or pipe joint 20 such that when received in the pipe slot 105, the weight of the pipe, tool section, tool or pipe joint 20 can be supported by the bit breaker.

We note in passing that in FIG. 17, the illustrated upper tool pipe 20 is not required to include the two crosswise flat-bottom grooves 25. Instead, they may be omitted. Since the second (e.g., upper) component of each joint may be rotated using means that do not engage such flat-bottom grooves, the flat-bottom grooves are not required for the second (e.g., upper) component.

In the embodiments illustrated, two jaws 300, 305 respectively define two working surfaces 310, 315 located on opposite sides 110, 115 of the pipe slot 105. In embodiments where the bit breaker has only one jaw, the jaw defines a working surface located on a side of the pipe slot. In such cases, the working surface of the jaw is configured to contact the pipe, tool section, tool or pipe joint, e.g., when the pipe, tool section, tool or pipe joint is rotated in the pipe slot relative to the stationary bit breaker.

With reference to FIG. 1, the two working surfaces 310, 315 of the illustrated jaws 300, 305 confront each other. These working surfaces 310, 315 are configured to contact the pipe, tool section, tool or pipe joint 20, e.g., when the pipe, tool section, tool or pipe joint 20 is rotated in the pipe slot 105 relative to the stationary bit breaker 10.

The two jaws 300, 305 can optionally be at least generally parallel to each other. In some cases, they are offset from parallel by no more than 30 degrees. In certain embodiments, they are at least substantially parallel to each other (e.g., offset by no more than 10 degrees), or they may be parallel to each other. Preferably, the two jaws 300, 305 do not have (i.e., are devoid of) arcuate configurations that match an outside (or "outer") radius of the pipe, tool section, tool or pipe joint. This can optionally be the case in any embodiment of the present disclosure.

Preferably, the working surfaces 310, 315 of the two jaws 300, 305 are flat working surfaces that are each devoid of any concave (e.g., semicircular) recess configured to receive a pipe, tool section, tool or pipe joint. For example, each of the working surfaces 310, 315 preferably is elongated along a line that is straight or at least substantially straight. This can optionally be the case in any embodiment of the present disclosure.

In the embodiments of FIGS. 1-8, each of the working surfaces 310, 315 has a rear extent that delineates a straight line while a front extent extends away from the rear extent at an acute angle. When provided, this angle preferably is less than 30 degrees, such as from 1-15 degrees. Thus, in FIGS. 1-8, the two rear extents of the two working surfaces 310, 315 are parallel to each other, whereas the two front extents diverge away from each other.

In the embodiments of FIGS. 9-16, 18A, and 19A, each of the illustrated working surfaces 310, 315 extends along a straight line such that these two working surfaces are parallel to each other. This, however, is by no means required.

In certain embodiments, instead of each working surface extending along a straight line, it is possible to have the working surface delineate one or more slight curves. Preferably, though, any such curved working surface does not have an arcuate configuration that matches the regular outside (or "outer") radius of the pipe, tool section, tool or pipe joint.

In preferred embodiments, the working surfaces 310, 315 are devoid of teeth. That is, the surfaces of the jaws that contact the pipe, tool section, tool or pipe joint preferably do not have teeth positioned to contact (e.g., bite into) the pipe, tool section, tool or pipe joint during use. It is to be understood, however, that various teeth, knurling, and or other grip features can be provided in other embodiments.

In some cases, the working surface of a jaw has one or more (e.g., a series of) recesses formed therein (e.g., carved, drilled, cut, or otherwise formed therein). For embodiments having two jaws, such recesses can optionally be formed in the working surface of each jaw. In such cases, for purposes of assessing whether two such working surfaces are generally parallel, substantially parallel, or parallel to each other, the non-recessed sections of each working surface are to be considered.

With conventional plate bit breakers, the plate itself defines the working surfaces that contact the pipe or drill stem. As a consequence, rotation of the pipe, tool section, tool or pipe joint in the pipe slot exerts pressure directly on the plate. As noted above, this results in a phenomenon known as the "mushroom effect," in which the plate begins to compress and swell in two distinct locations, namely the two points where surfaces of the two flat-bottom grooves on the pipe, tool section, tool or pipe joint contact the plate. Considerable damage to the plate can occur because all the force from the pipe, tool section, tool or pipe joint is placed on a very small area of the working surfaces of the plate. Over time, the resulting deformation can become so great that the plate can no longer securely hold the pipe, tool section, tool or pipe joint against rotation in the pipe slot. Once the deformation is so extensive that the pipe, tool section, tool or pipe joint can rotate within the pipe slot, the plate is rendered useless for its intended purpose and is normally discarded and replaced.

To address the "mushroom effect" noted above, two jaws 300, 305 can be mounted removably to the plate 100 of the bit breaker 10. As noted above, in other case, there may be only a single jaw. The removable nature of the (or each) jaw enables it to be removed from the plate 100 once it has become sufficiently worn or damaged, and thereafter replaced with a new jaw. This eliminates the material waste and cost associated with replacing the entire plate 100 when only the noted working surface(s) are damaged.

The plate can optionally define a connection ledge that is recessed from the top face of the plate. In the embodiments illustrated, the plate 100 preferably defines two connection ledges 130, 135 that are recessed from the top face 120 of the plate 100 (see FIGS. 5 and 13). This can optionally be the case in any embodiment of the present disclosure. In such cases, the two jaws 300, 305 are respectively mounted removably to the two connection ledges 130, 135. This can be accomplished via fasteners 320, such as mechanical fasteners (e.g., bolts). Thus, each connection ledge 130, 135 can optionally have one or more apertures (e.g., one or more bores) configured to receive one or more respective fasteners 320. In certain preferred embodiments, each connection ledge has only one such aperture.

When provided, the (or each) connection ledge can optionally be provided with a debris management system. More will be said of this later.

In some cases, when the jaw or jaws 300, 305 of the bit breaker 10 are mounted to the plate 100, the upper face 350, 355 of each jaw is flush or substantially flush with, or at least substantially parallel to, the top face 120 of the plate 100. This, however, is not required.

In the embodiments illustrated, each jaw 300, 305 has a jaw plate 325, 330 and a jaw flange 335, 340. In such cases, each jaw flange 335, 340 preferably extends away from its respective jaw plate 325, 330 in a generally perpendicular manner. In more detail, the two jaw flanges 335, 340 can optionally define the two working surfaces 310, 315 of the bit breaker 310. Thus, the jaw flanges 335, 340 can be exposed to (e.g., can bound) the pipe slot when the bit breaker is operatively assembled. In embodiments where the bit breaker has only a single jaw, the jaw can likewise have a flange that defines the working surface. Each jaw 300, 305, and specifically the jaw plate 325, 330 of each jaw 300, 305, can optionally have one or more apertures 345 formed therein. When provided, each such aperture 345 preferably is configured to receive a fastener 320 for mounting each jaw 300, 305 to a respective connection ledge 130, 135. In some cases, each of the two jaws 300, 305 and a respective connection ledge 130, 135 has a generally rectangular configuration.

In preferred embodiments, the plate 100 of the bit breaker 10 defines two fixed arms 140, 145 and a fixed base leg 150. The pipe slot 105 is located between the two fixed arms 140, 145 of the plate 100. In the illustrated embodiments, the two fixed arms 140, 145 project respectively from opposed ends 155, 160 of the fixed base leg 150. The two fixed arms 140, 145 are non-adjustable in that relative positions of the two fixed arms 140, 145 and the fixed base leg 150 are fixed. Similarly, a width of the pipe slot 105 may be non-adjustable (e.g., in that the distance between the two fixed arms 140, 145 is fixed). Preferably, the plate 100 is a single body (e.g., formed of steel) that defines the fixed base leg and both of the fixed arms.

Thus, in preferred embodiments, the plate 100 comprises a single, generally flat body that entirely surrounds three sides 110, 112, 115 of the pipe slot 105. However, it is also envisioned that in some embodiments, the plate 100 is formed by separate and distinct plate sections that can be coupled (e.g., welded) together. For example, three different bodies respectively defining the base leg and the two arms could be attached together to define the plate, or, two separate and distinct plate sections (each having the ability to accept one or more jaws) can be positioned in a spaced-apart relationship and mounted to a working surface 45 (e.g., a table 50).

Figure 3:
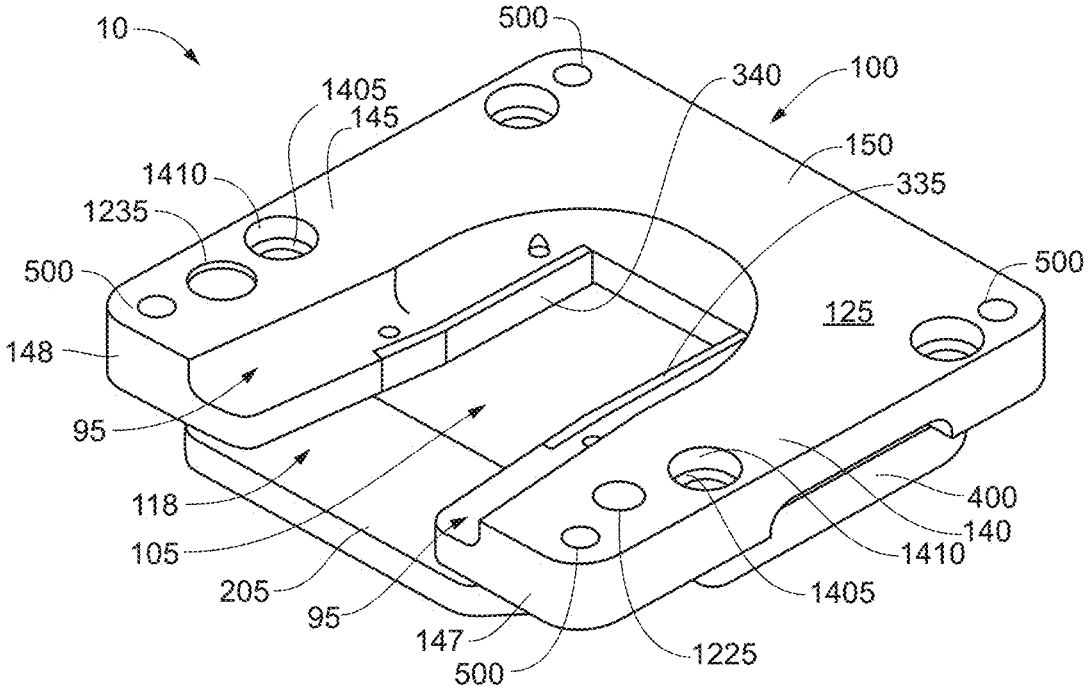
FIG. 3 is a bottom perspective view of the bit breaker of FIG. 1.
Figure 4:
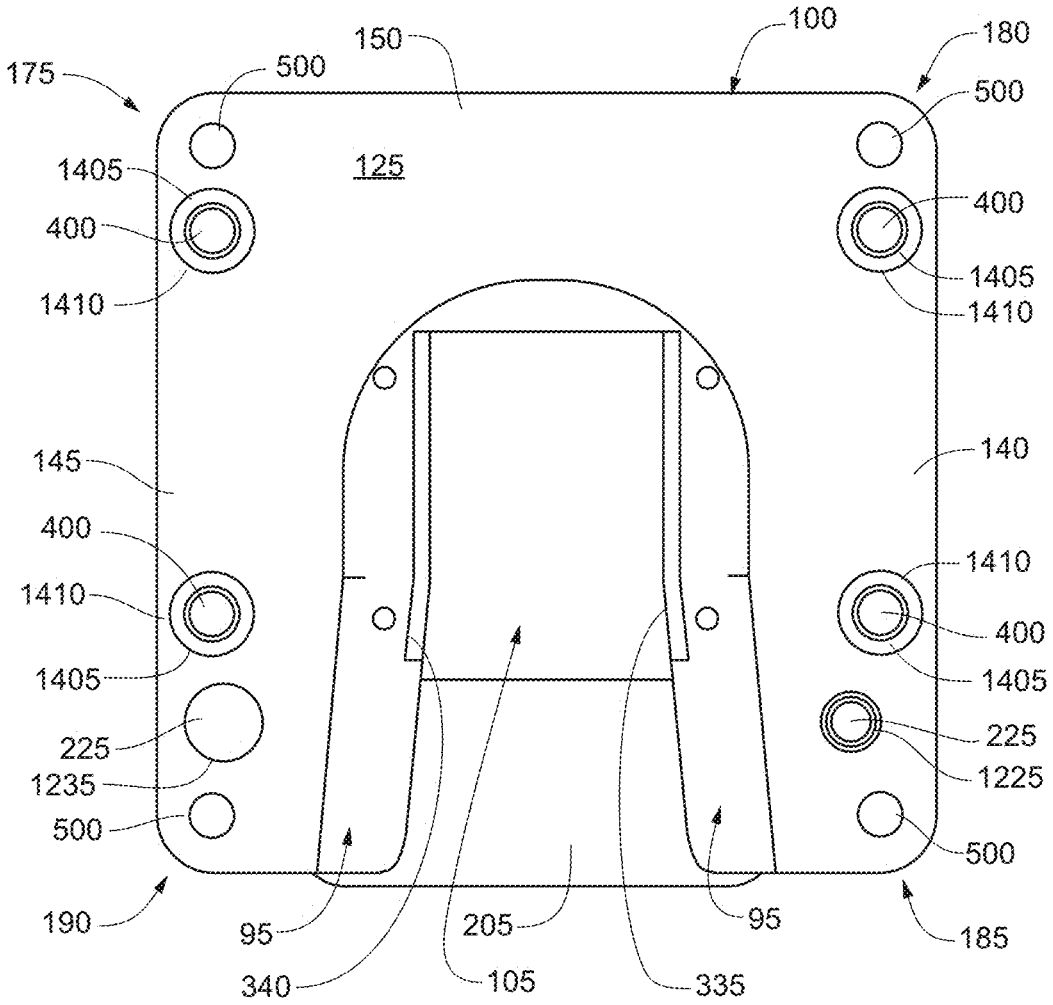
FIG. 4 is a bottom view of the bit breaker of FIG. 1.

As shown in FIG. 3, the plate 100 can optionally have a recessed area 95 on its bottom face 125. When provided, the recessed area 95 can be shaped to provide space for accommodating a head of a drill bit 65 (see FIG. 17) or another upper portion of a pipe, tool section, tool or pipe joint 20. As is perhaps best shown in FIGS. 3 and 11, the optional recessed area 95 on the bottom of the plate 100 can surround, or otherwise be adjacent to, the pipe slot 105. It is to be appreciated that the present bit breaker is by no means required to have such a recessed area 95 in the bottom face of the plate.

Figure 7:
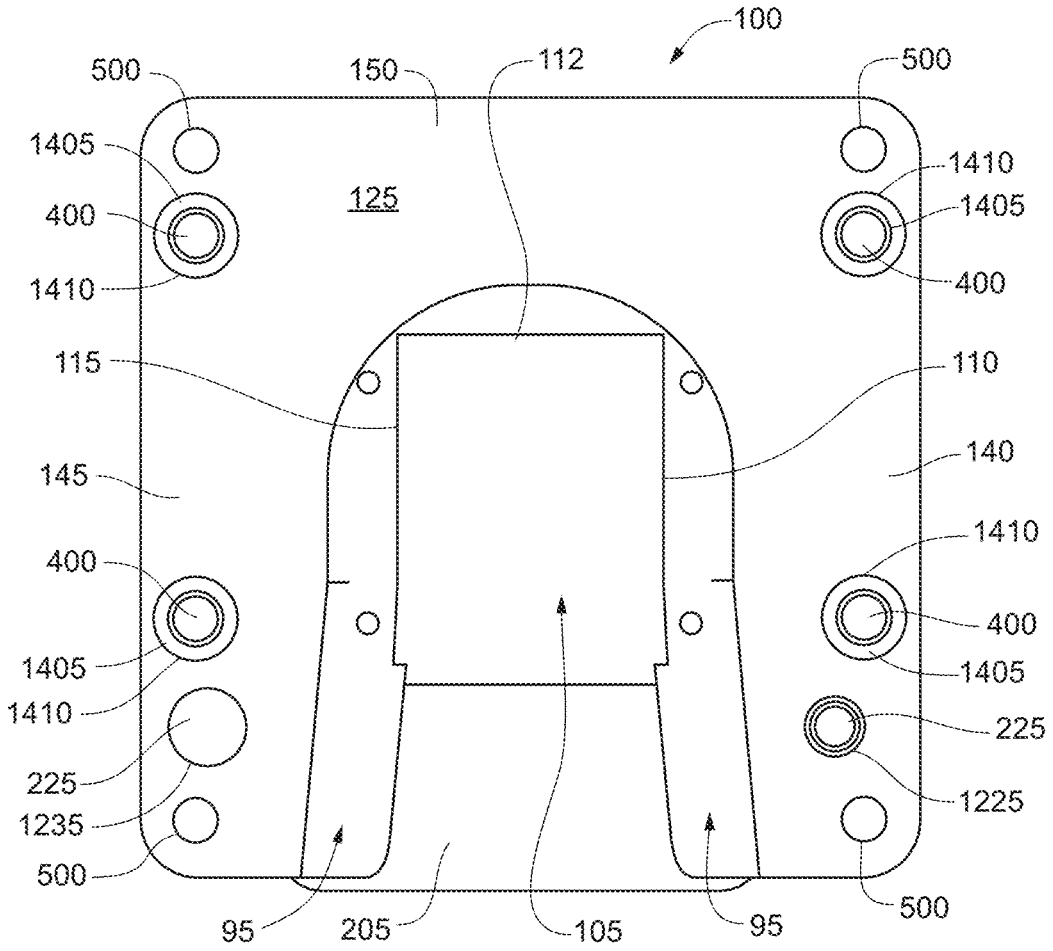
FIG. 7 is a bottom view of the bit breaker of FIG. 1 with the jaws removed from the plate of the bit breaker.
Figure 8:
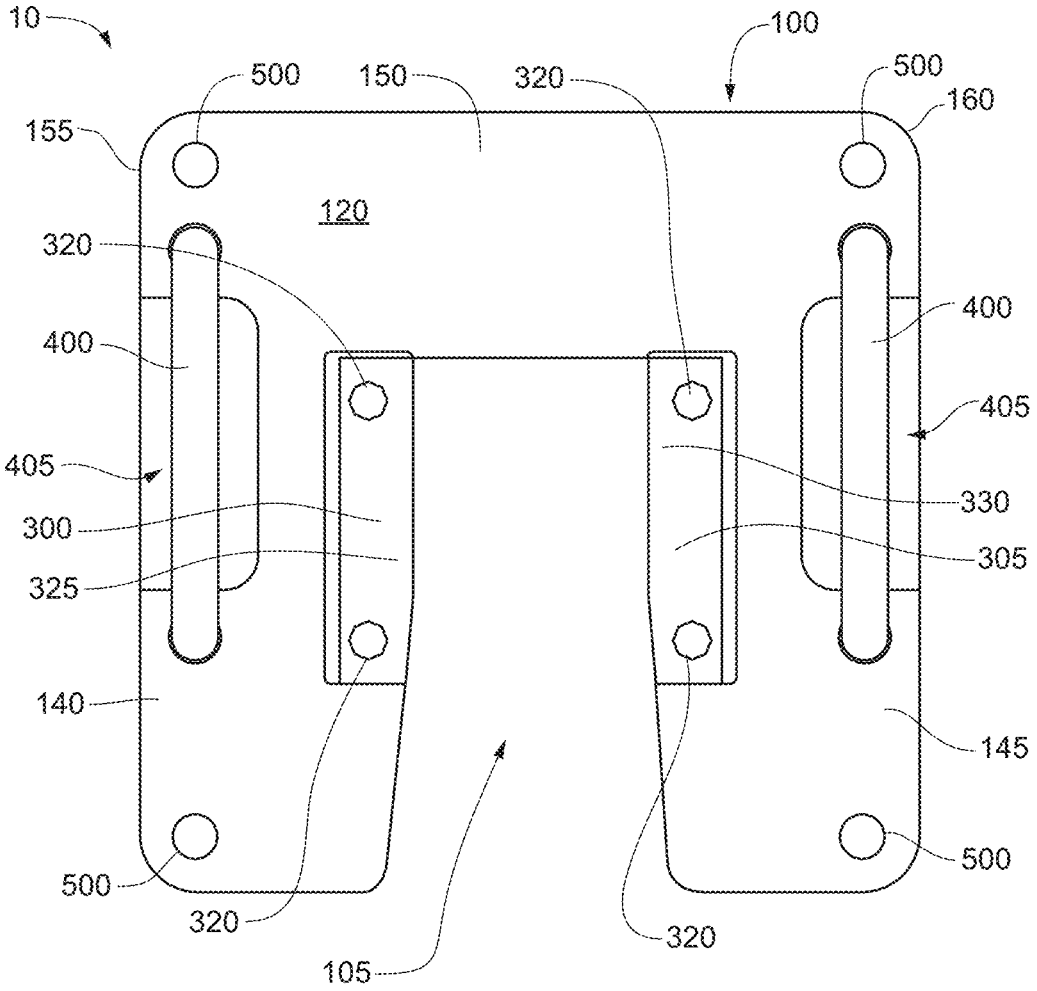
FIG. 8 is a top view of a bit breaker in accordance with certain other embodiments of the present disclosure.
Figure 9:
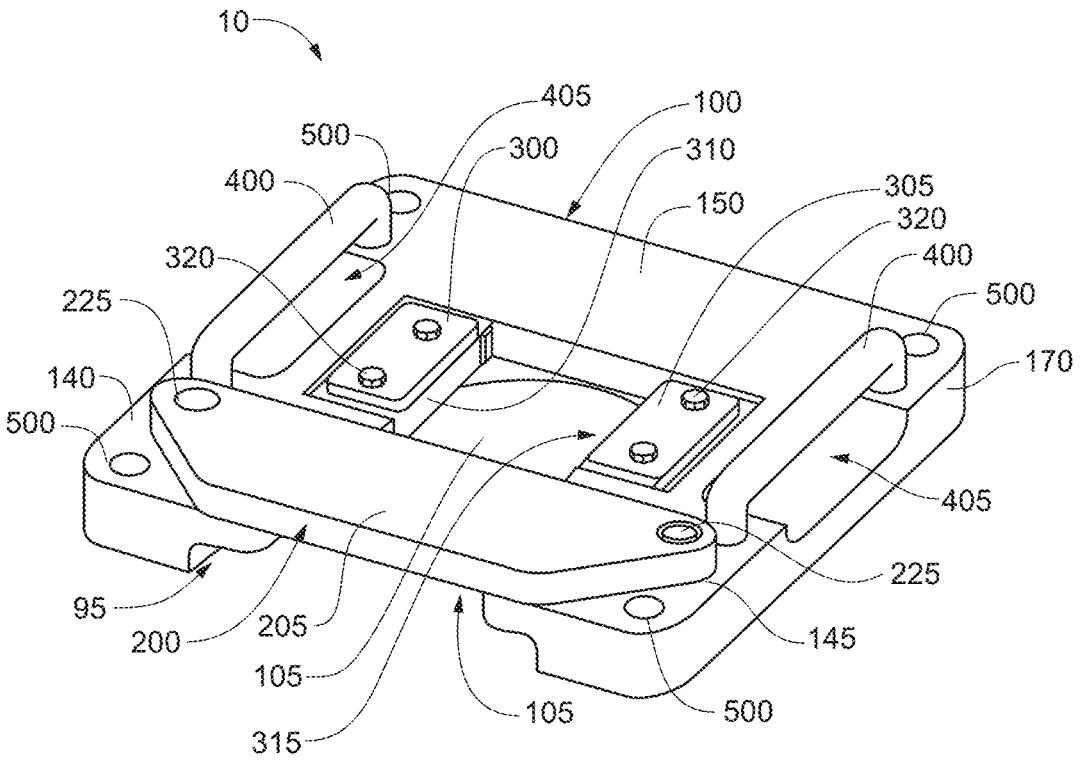
FIG. 9 is a top perspective view of a bit breaker in accordance with still other embodiments of the present disclosure wherein a pair of movable, self-adjusting jaws is mounted to a plate of the bit breaker.

Preferably, the pipe slot 105 (e.g., a front region thereof) tapers outwardly along its opposite sides 110, 105 in a direction extending away from the fixed base leg 150 (see FIG. 7). This configuration facilitates readily sliding the bit breaker 10 into the flat-bottom grooves on the pipe, tool section, tool or pipe joint 20. This gives the pipe slot an open mouth, e.g., having a width that is greater than the width of the rest of the pipe slot. As noted above, the jaws 300, 305 (e.g., front extents thereof) can optionally taper outwardly in the same manner (see FIG. 4).

In some embodiments, the bit breaker 10 includes a locking mechanism 200 for securing the bit breaker 10 on a pipe, tool section, tool or pipe joint 20 (and/or for securing the pipe, tool section, tool or pipe joint 20 in the pipe slot 105). When provided, the locking mechanism 200 preferably comprises an adjustable arm 205 having a closed position 210 and an open position (see FIG. 20). When the adjustable arm 205 is in its open position, the pipe slot has an open side. In such cases, the open side enables the bit breaker 10 to be mounted on a pipe, tool section, tool or pipe joint by moving the bit breaker laterally relative to the pipe, tool section, tool or pipe joint (and/or by moving the pipe, tool section, tool or pipe joint laterally relative to the bit breaker). For example, the bit breaker 10 can be mounted on the pipe, tool section, tool or pipe joint 20 by aligning the bit breaker with a pair of flat bottom grooves 25 on the pipe, tool section, tool or pipe joint, and then sliding the bit breaker into those grooves. Furthermore, when the adjustable arm 205 is in its open position, the resulting open side of the pipe slot 105 enables the bit breaker to be removed from a pipe, tool section, tool or pipe joint by moving the bit breaker laterally relative to the pipe, tool section, tool or pipe joint (and/or by moving the pipe, tool section, tool or pipe joint laterally relative to the bit breaker). When the adjustable arm 205 is in its closed position 205, the pipe slot 105 is surrounded about 360 degrees by the bit breaker 10. In more detail, when the illustrated adjustable arm 205 is in its closed position 210, two opposed ends 215, 220 of the adjustable arm 205 are mounted respectively to two free ends 147, 148 of the two fixed arms 140, 145. In contrast, when the adjustable arm 205 is in its open position, the fourth side 118 of the illustrated pipe slot 105 is open.

A locking mechanism 200 can be useful, for example, when an operator initially positions the bit breaker on a pipe, tool section, tool or pipe joint (e.g., before the bit breaker is anchored to a table or other working surface). When provided, the locking mechanism 200 can optionally be attached to the plate 100 such that it can be removed from the plate 100 when desired. Additionally or alternatively, when the locking mechanism is provided, it can optionally be attached pivotally to the plate such that one end of the locking mechanism stays attached to the plate while the other end is pivoted away from the plate so as to open one side of the pipe slot. This is the case in the embodiments of FIGS. 1-7, 9-15, 17, and 20.

One or more fasteners 225, such as welded pins (and/or bolts or other conventional fasteners), can be used to pivotally attach the locking mechanism 200 to the plate 100. As is perhaps best appreciated with reference to FIGS. 5, 13, and 20, one end (e.g., the right end as seen in these figures) of the adjustable arm 205 can be attached pivotally to one fixed arm of the plate 100 while the other end (e.g., the left end as seen in these figures) of the adjustable arm is adapted to be attached releasably/temporarily to the other fixed arm of the plate.

Figure 5:
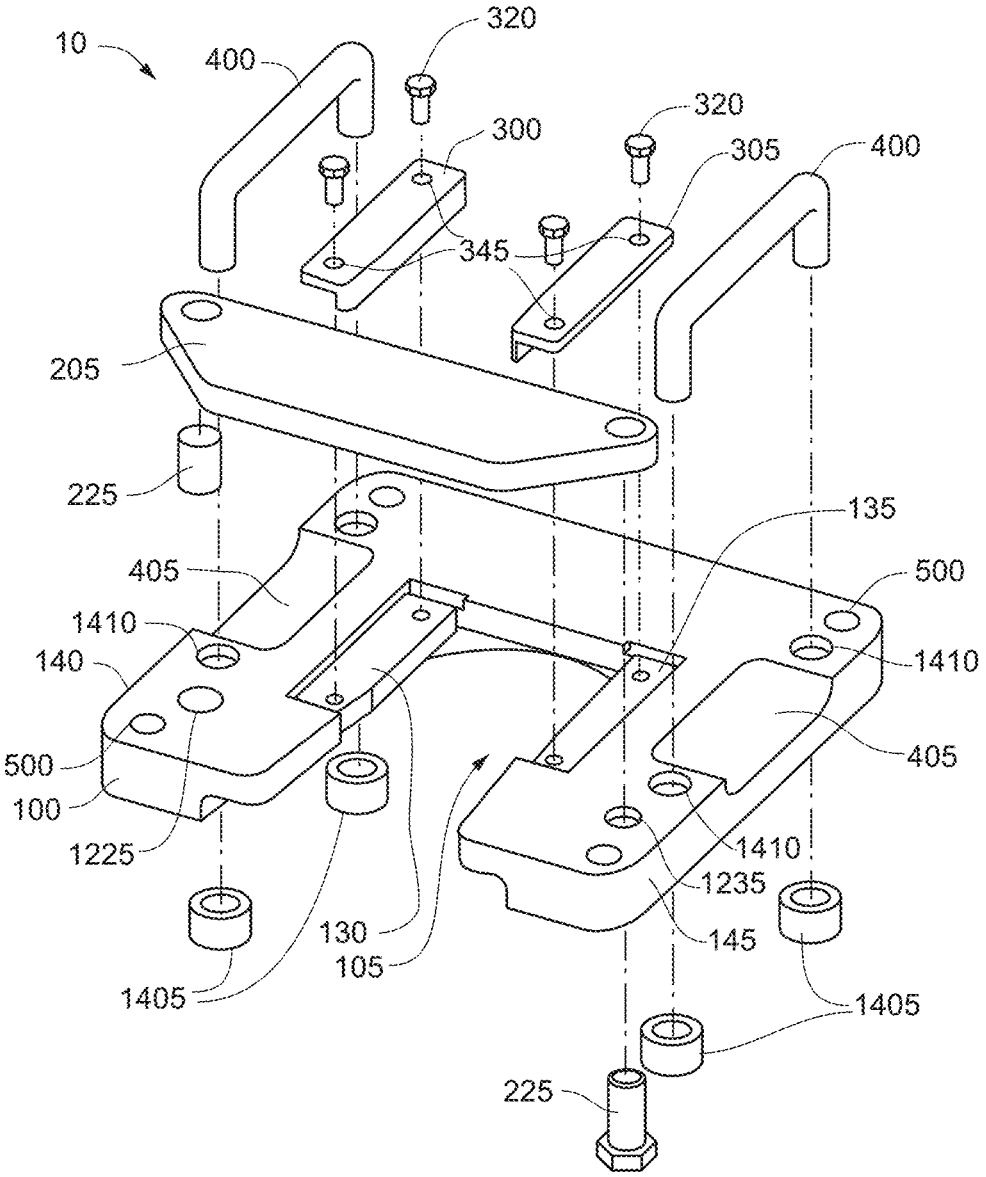
FIG. 5 is an exploded view of the bit breaker of FIG. 1.
Figure 6:
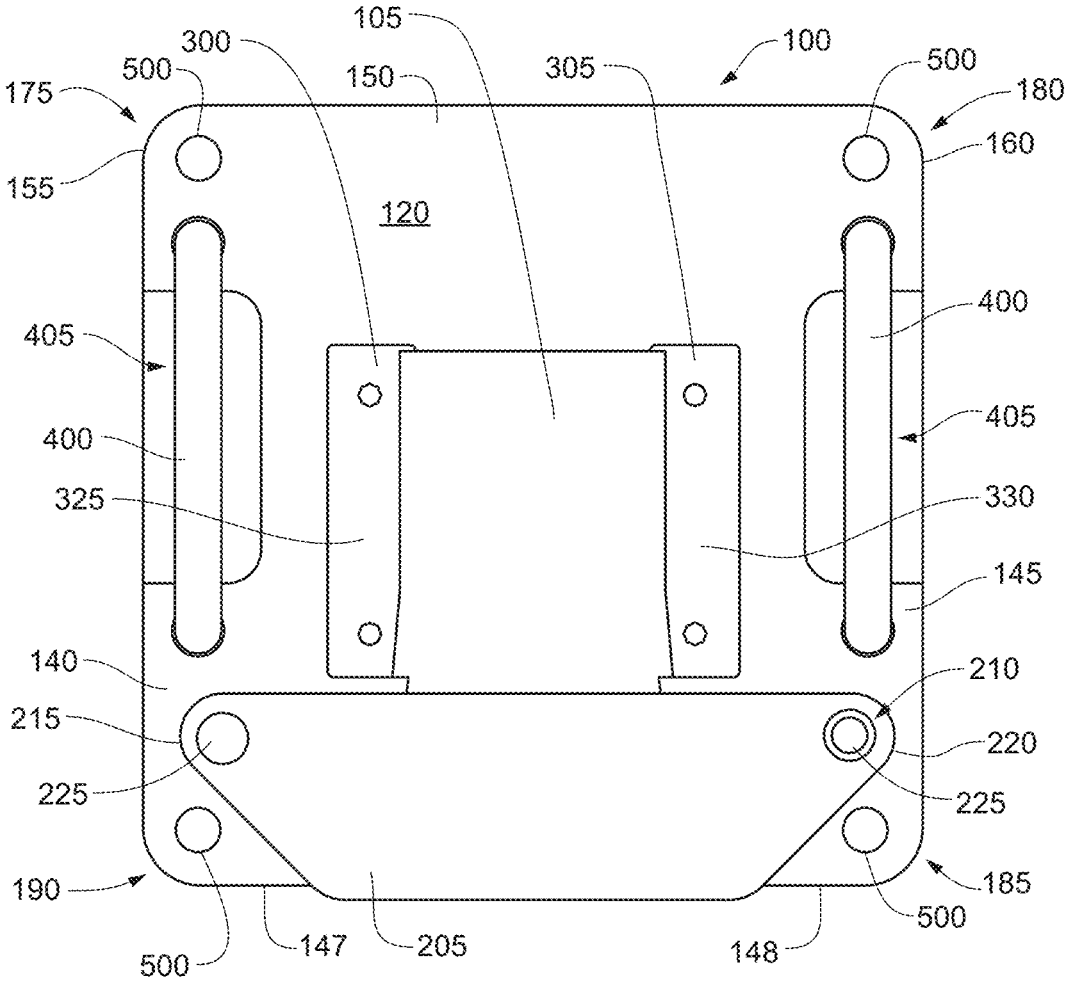
FIG. 6 is a top view of the bit breaker of FIG. 1 with the jaws removed from the plate of the bit breaker.
Figure 10:
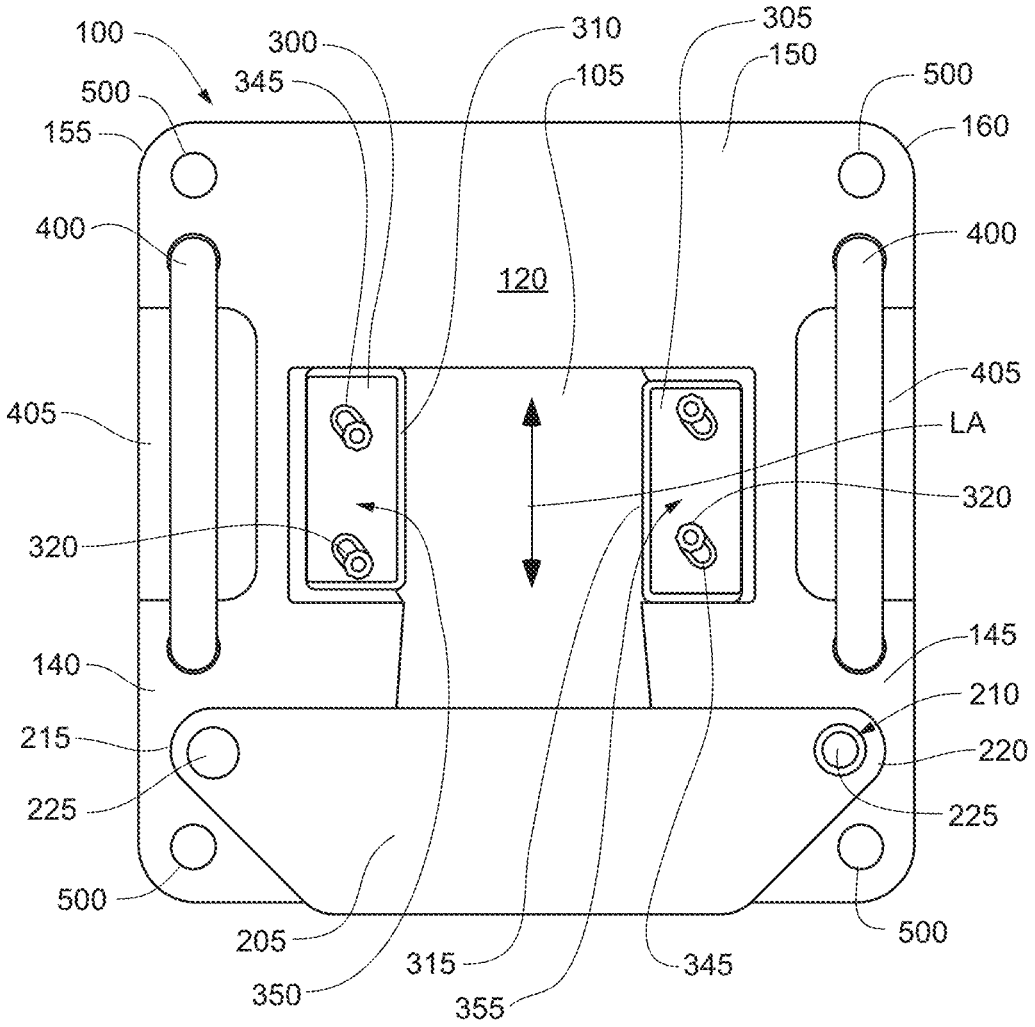
FIG. 10 is a top view of the bit breaker of FIG. 9.
Figure 11:
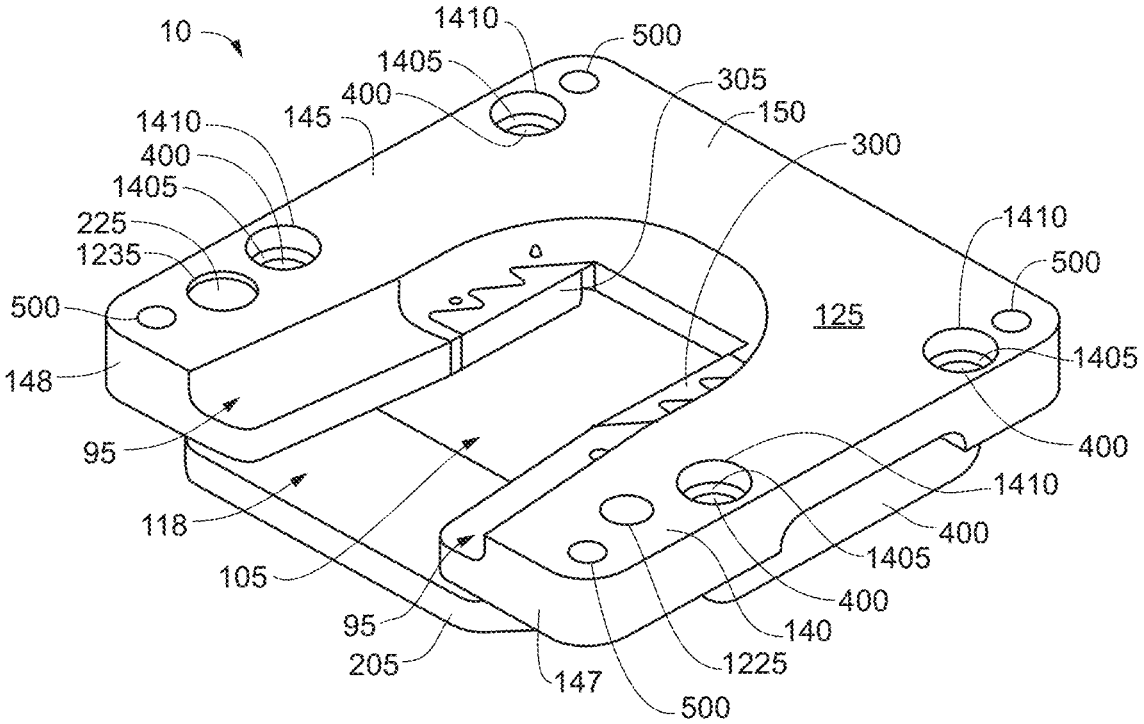
FIG. 11 is a bottom perspective view of the bit breaker of FIG. 9.
Figure 12:
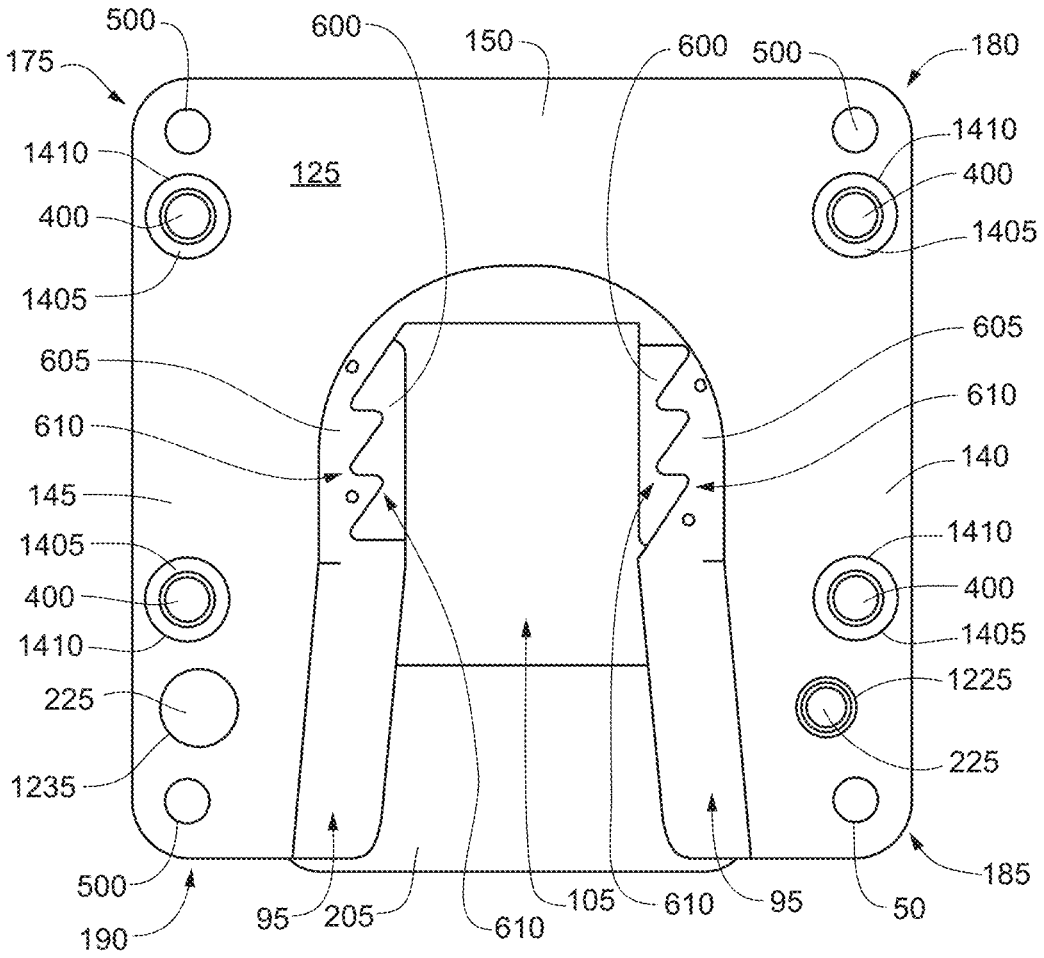
FIG. 12 is a bottom view of the bit breaker of FIG. 9.
Figure 13:
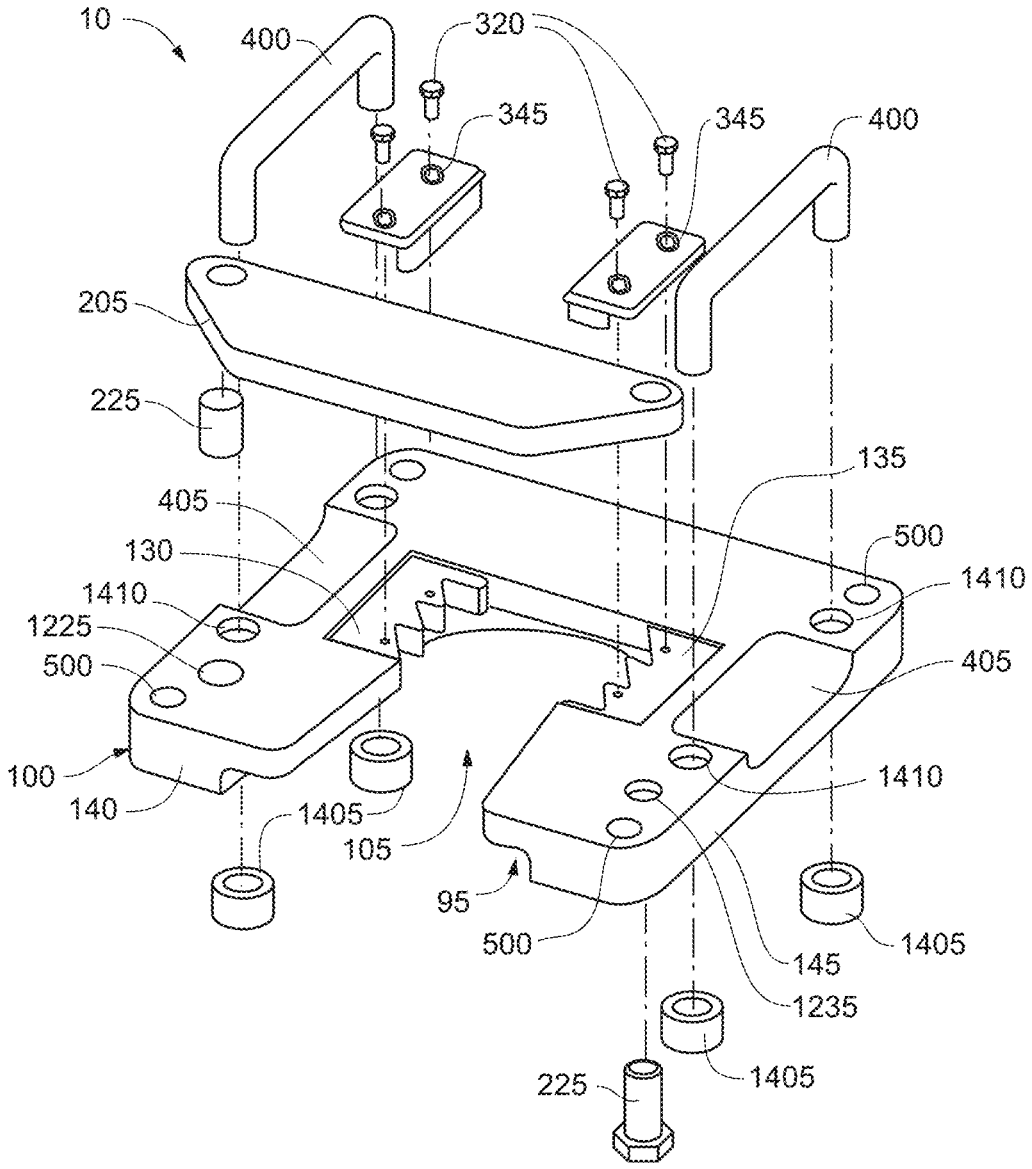
FIG. 13 is an exploded view of the bit breaker of FIG. 9.
Figure 14:
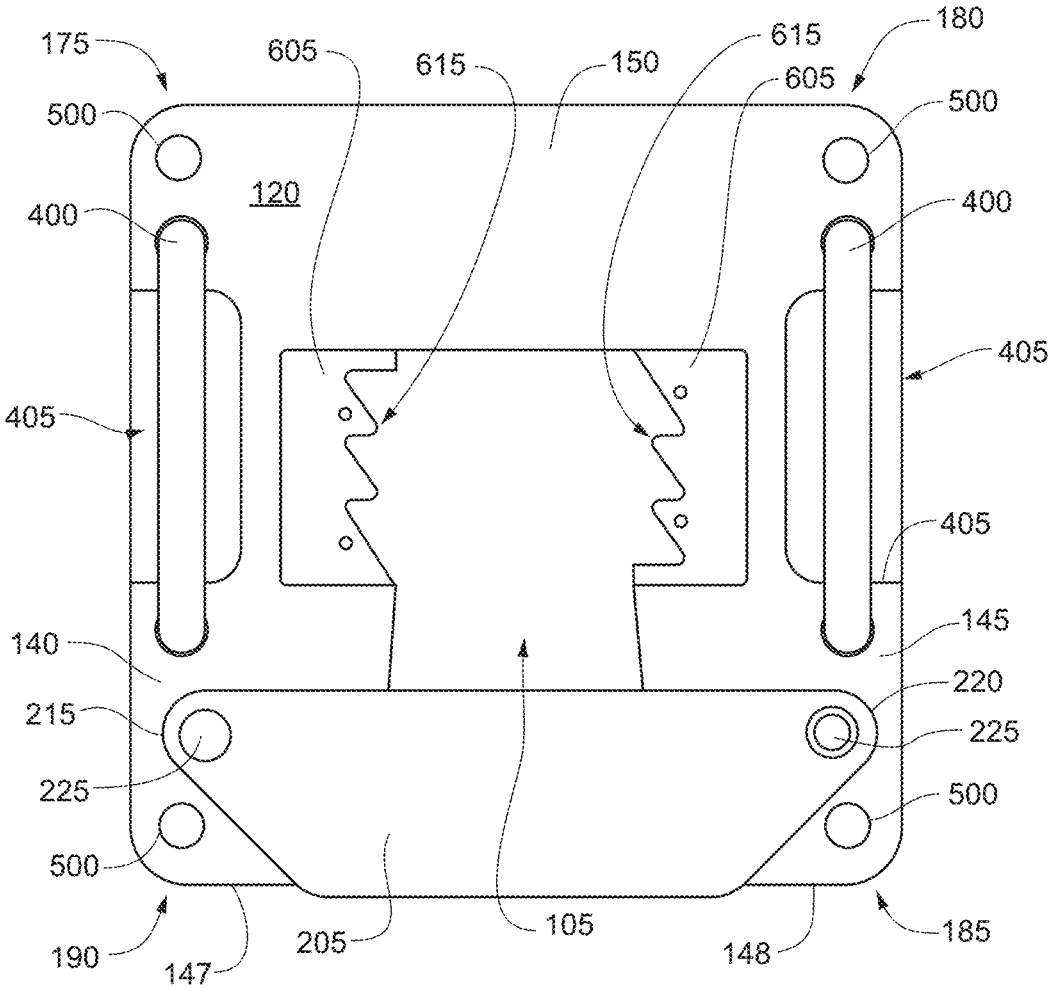
FIG. 14 is a top view of the bit breaker of FIG. 9 with the jaws removed from the plate of the bit breaker.
Figure 15:
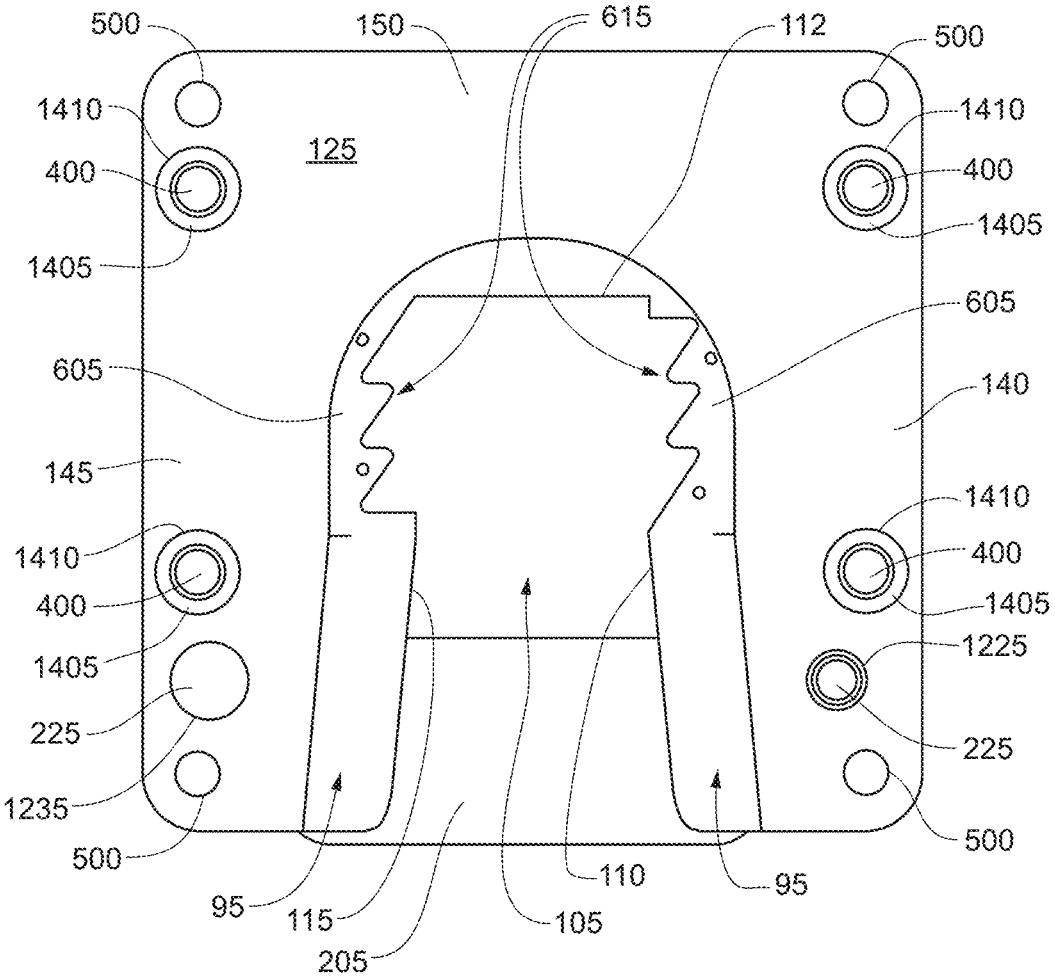
FIG. 15 is a bottom view of the bit breaker of FIG. 9 with the jaws removed from the plate of the bit breaker.
Figure 16A:
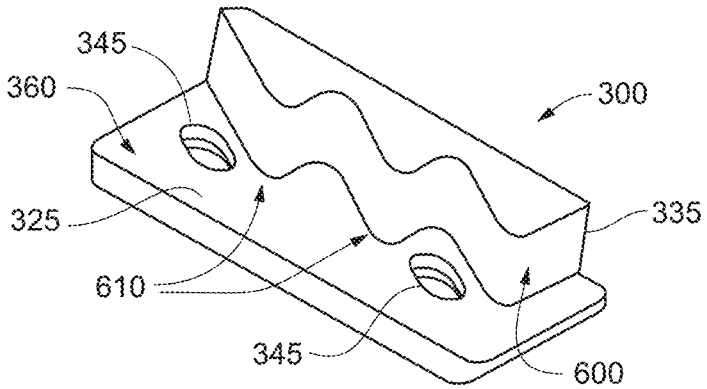
FIG. 16A is a bottom perspective view of one of the movable, self-adjusting jaws of the bit breaker of FIG. 9.
Figure 16B:
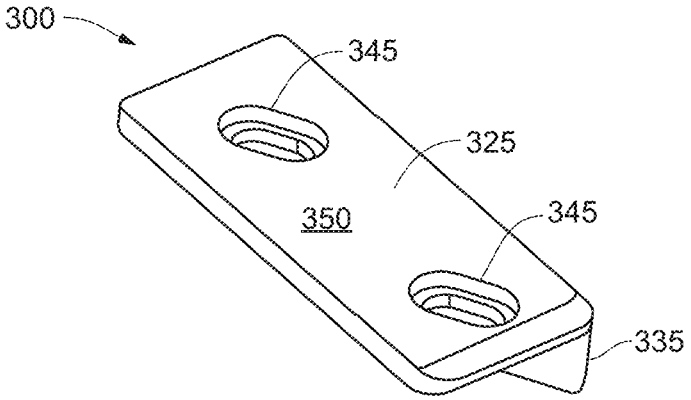
FIG. 16B is a top perspective view of the movable, self-adjusting jaw of FIG. 16A.
Figure 16C:
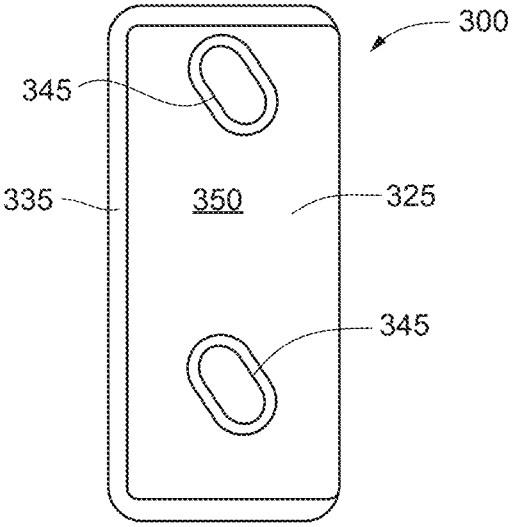
FIG. 16C is a top view of the movable, self-adjusting jaw of FIG. 16A.
Figure 20:
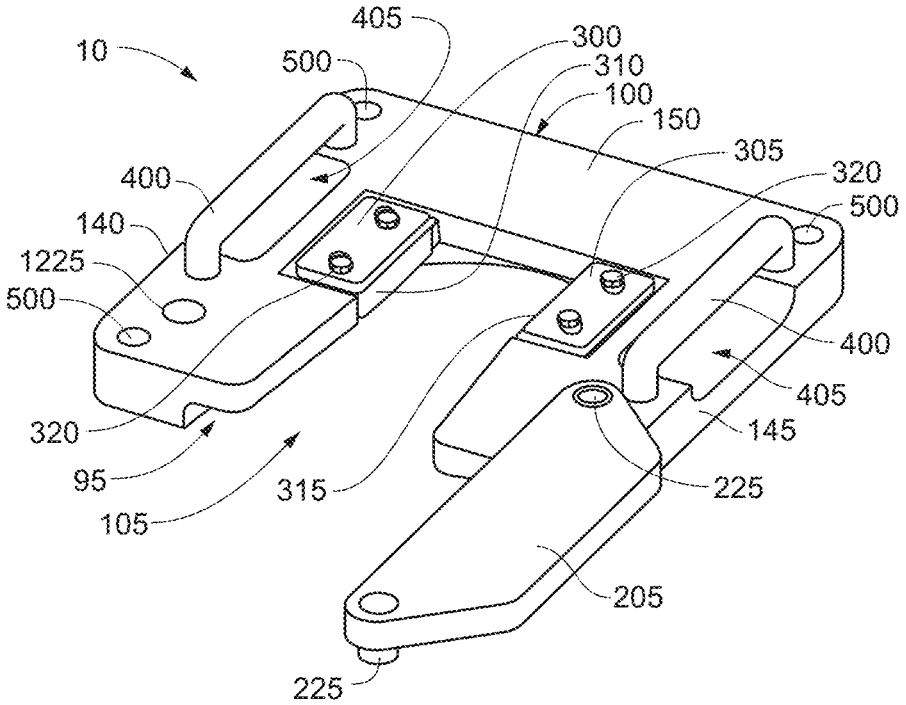
FIG. 20 is a top perspective view of the bit breaker of FIG. 9, showing an adjustable arm thereof in an open position.
Figure 21:
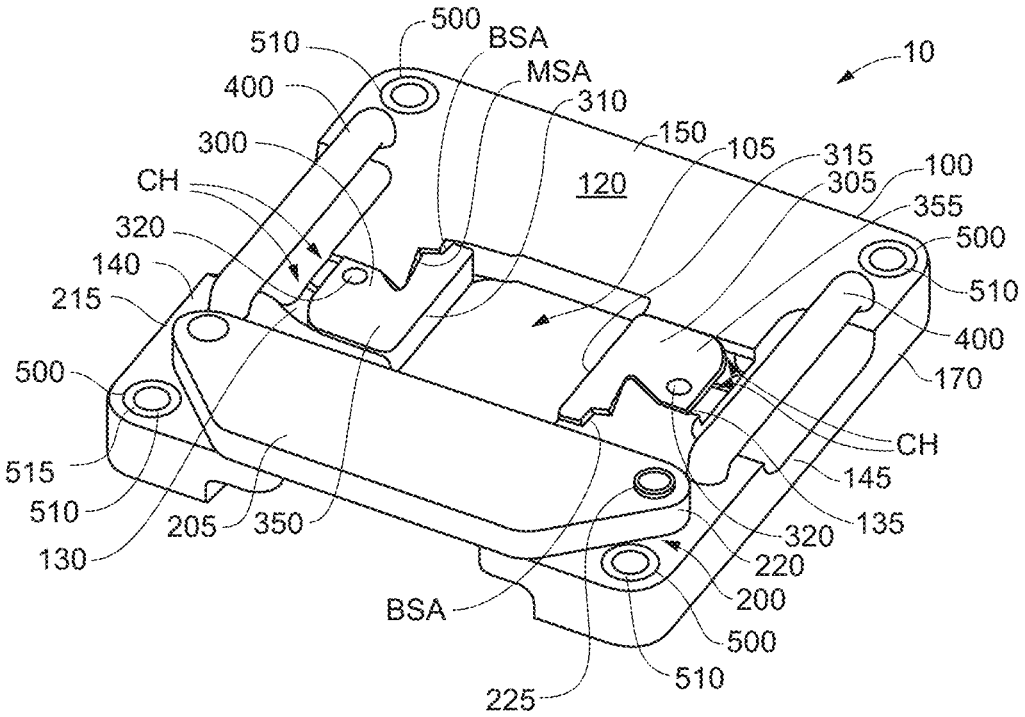
FIG. 21 is a top perspective view of a bit breaker in accordance with another embodiment of the present disclosure, showing an optional adjustable arm thereof in a closed position.
Figure 22:
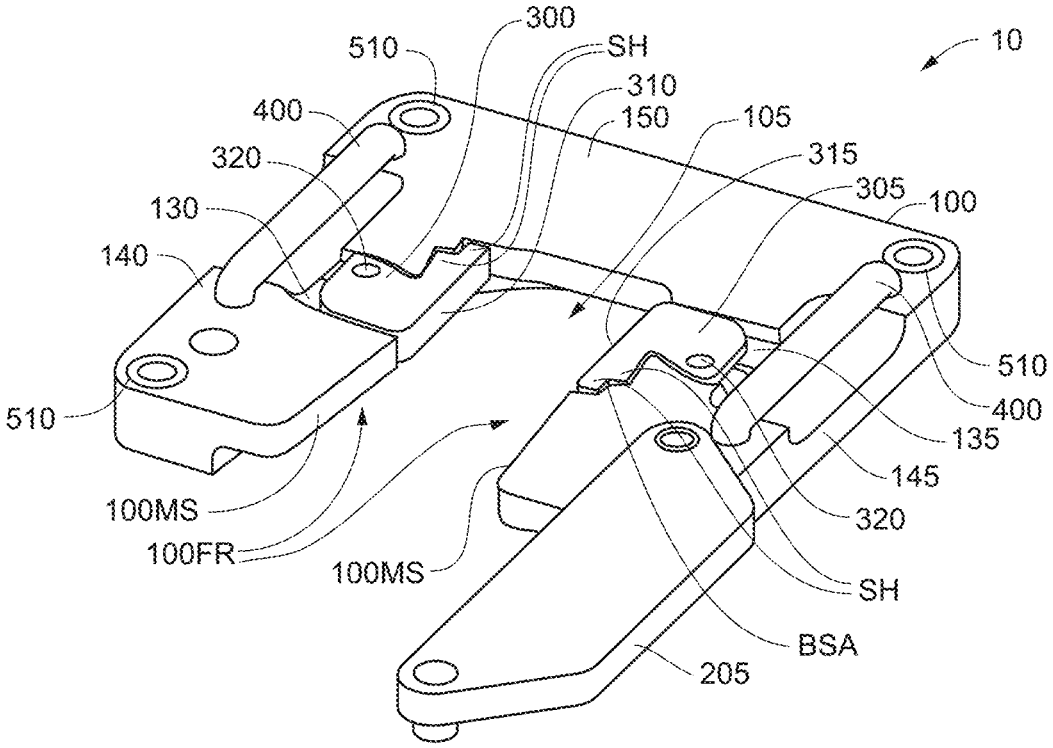
FIG. 22 is a top perspective view of the bit breaker of FIG. 21, showing the optional adjustable arm in an open position.

With reference to FIGS. 2 and 10 in view of FIGS. 5, 13, and 20, the right end of the illustrated adjustable arm 205 is mounted pivotally (i.e., so the arm is configured to pivot relative) to the plate 100 by a pin 225 having an enlarged base and a relatively narrow neck projecting away from the base. The base of the illustrated pin is received in a countersunk bore 1235 extending upwardly through the plate 100, and a top region of the neck of the pin is welded to the right end of the adjustable arm. This pin is thus free to rotate in the countersunk bore 1235 and to move axially in that bore over a limited range, so as to enable the adjustable arm 205 to be lifted upwardly a bit relative to the plate 100. The left end of the illustrated adjustable arm also has a pin 225 welded to it. The bottom end of that pin can be aligned with, and dropped into, a corresponding bore 1225 in the plate 100. When it is desired to open the adjustable arm 205, it can be raised up a bit relative to the plate 100 and pivoted (counterclockwise as seen in FIGS. 2 and 10) relative to the plate. On the other hand, when it is desired to close the adjustable arm 205, it can be raised up a bit relative to the plate and pivoted (clockwise as seen in FIGS. 2 and 10) so that the pin 225 welded to its left end moves into alignment with bore 1225. The adjustable arm can then be lowered relative to the plate, so that the pin 225 on the left end of the adjustable arm 205 drops into bore 1225. These details, however, are by no means limiting.

The illustrated adjustable arm 205 is a single elongated body, although it could alternatively be formed by two or more separate segments. The illustrated arm 205 has a straight edge that bounds the pipe slot. If desired, the arm can alternatively have a curved (e.g., semicircular) edge that bounds the pipe slot. Thus, the pipe slot may have a generally ovular or generally egg-shaped configuration. In some cases, the adjustable arm comprises (e.g., is) a pivotal latch (i.e., a latch that is configured to pivot). Instead of an adjustable arm 205, other locking mechanisms 200 can be used, such as a chain and hook or the like. Moreover, in certain embodiments, the bit breaker 10 is devoid of a locking mechanism 200 (see FIGS. 8, 18A and 19A).

In some embodiments, the jaws 300, 305 are rigid, stationary parts of the bit breaker 10 (see FIGS. 1-8). In embodiments of this nature, when the bit breaker 10 is operatively assembled, the jaws 300, 305 are non-adjustable (i.e., not moveable relative to the plate). In such instances, the jaws 300, 305 do not move (at least not substantially) relative to the plate 10 when the pipe, tool section, tool or pipe joint 20 is rotated against the jaws. A single jaw of this nature may be provided in certain embodiments where the bit breaker has only one jaw.

In other embodiments, two jaws 300, 305 are moveable relative to the plate 100 (see FIGS. 9-16C, 18A, 18B, 19A, 21-24, 26-28, and 31-36). In some cases, the two jaws 300, 305 are configured to move generally toward each other (so as to narrow a width of the pipe slot 105) and/or to pivot or otherwise rotate relative to the plate 100. For example, the two jaws 300, 305 in some cases may be configured to move (generally toward each other and/or by pivoting or otherwise rotating) in response to the pipe, tool section, tool or pipe joint 20 rotating in the pipe slot 105 against the two working surfaces 310, 315 of the two jaws 300, 305. In embodiments of this nature, the jaws 300, 305 preferably are self-adjusting in that when the pipe, tool section, tool or pipe joint 20 is rotated and the flat-bottom grooves 25 contact the jaws 300, 305, the jaws move in response so as to engage (or move more firmly and/or more extensively against) the flat bottoms 40 of the flat-bottom grooves 25. Preferably, this self-adjustment results in the working surfaces of the jaws contacting the flat bottoms of the two flat-bottom grooves along a longer extent than was the case prior to the self-adjustment. A single moveable jaw of this nature may be provided in certain embodiments where the bit breaker has only one jaw. Moreover, if desired, the bit breaker can have two jaws of different shapes and/or types, e.g., one that is replaceable but not moveable relative to the plate when the bit breaker is operatively assembled, and another that is moveable relative to the plate when the bit breaker is operatively assembled. FIGS. 33 and 34 show one embodiment wherein one of two movable jaws on the plate is shaped differently than the other.

Thus, as noted above, although two jaws 300, 305 are described in various sections of the present disclosure, a single jaw can alternatively be provided. In such cases, the single jaw comes into contact with a flat bottom 40 of one of the flat-bottom grooves 25 during operation.

In some embodiments where at least one jaw is movable relative to the plate, each such jaw can optionally have a first geometric camming structure 600 carried alongside an adjacent second geometric camming structure 605, which is defined by one of the two fixed arms 140, 145 of the plate 100. In such cases, the second geometric camming structure 605 preferably is defined by a connection ledge 130, 135. When provided, the first geometric camming structure 600 can have a shape configured to cam with the adjacent second geometric camming structure 605. In some cases, the first geometric camming structure 600 comprises a series of angled first teeth 610, and the second geometric camming structure 605 comprises a series of angled second teeth 615.

In such cases, the series of angled first teeth 610 is positioned to cam with (e.g., is carried alongside) the adjacent series of angled second teeth 615.

In the embodiments of FIGS. 9-16 and 18A-20, each jaw 300, 305 is configured to move along an axis defined by the interface angle of the angled first 610 and second 615 teeth. The resulting camming action forces the jaws 300, 305 to move toward (or more firmly and/or more extensively against) the pipe, tool section, tool or pipe joint 20, e.g., such that the jaws 300, 305 tighten on the flat bottoms 40 of the flat-bottom grooves 25. Although angled camming teeth are shown in FIGS. 9-16 and 18A-20, a variety of other camming structures can be used (e.g., different teeth angles or various cam surface curvatures). Moreover, the jaw or jaws can be configured to move relative to the plate by various means; camming teeth or other camming structures are not required.

In the illustrated movable-jaw embodiments, the jaws 300, 305 preferably have apertures 345 for mounting the jaws 300, 305 to the connection ledges 130, 135. In FIGS. 9-16 and 18A-20, the illustrated apertures 345 are elongated (e.g., oblong or slot-like) so that fasteners 320 can move within the apertures 345 to permit the noted camming movement of the jaws 300, 305. Here, the elongated apertures 345 serve as tracks that provide the jaws with a limited range of freedom to move relative to the plate 100. The fasteners 320 can optionally comprise pins welded to, or bolts (e.g., shoulder bolts) threaded into, the connection ledges and having enlarged heads that prevent the jaws from coming off the fasteners 320. In embodiments where the bit breaker has only one moveable jaw, the jaw can have any of the features described in this paragraph.

While each moveable jaw in FIGS. 9-16 and 18A-20 is shown as being mounted to the plate by two fasteners 320, the number of fasteners used is not limiting. In certain preferred embodiments, the (or each) moveable jaw has only one fastener 320 connecting it to the plate. This can be appreciated by referring to FIGS. 21-36.

Thus, in certain embodiments, the bit breaker 10 has one or more jaws 300, 305 that are moveable relative to the plate 100 in a non-orthogonal manner. In some embodiments of this nature, when each jaw moves further into the pipe slot 105, it moves along an acute angle relative to a longitudinal axis LA of the bit breaker 10 (see FIG. 10). That acute angle may be less than 60 degrees, e.g., in the range of from 5-55 degrees, such as about 45 degrees. The longitudinal axis LA is parallel to the illustrated working surfaces 310, 315 of the jaws 300, 305. In embodiments of this nature, the two jaws 300, 305 can optionally be configured to move closer to each other (e.g., so as to shorten the width of the pipe slot 105 between them) without moving straight toward each other. For example, the two jaws may be configured to move respectively along two axes that are parallel to each other and offset from the longitudinal axis by an acute angle.

If desired, the two jaws 300, 305 can each be configured to (e.g., mounted so as to) pivot or otherwise rotate relative to the plate 100. In some embodiments of this nature, each such jaw is configured to rotate (optionally by no more than 10 degrees, or no more than 5 degrees) when it moves so as to seat against a flat bottom of a corresponding flat-bottom groove of a pipe, tool section, tool or pipe joint 20.

In some embodiments, a separate source of force is provided to assist in moving the jaw or jaws 300, 305 of the bit breaker 10. For example, at least one biasing member 360 (e.g., a spring) can optionally be provided for each jaw 300, 305 such that each jaw is under constant bias toward an engage position and/or toward the pipe slot 105 (see FIGS. 18A and 18B). The resulting bias can push, or help push, the moveable jaw or jaws 300, 305 against (or more firmly and/or fully against) the pipe, tool section, tool or pipe joint 20. When provided, each biasing member 360 can optionally be mounted in a bore recessed into the plate 100 of the bit breaker 10. When provided, the biasing members 360 can optionally be present on the bit breaker 10 in combination with a jaw camming structure of the nature described above or in combination with the jaw or jaws being pivotable relative to the plate.

In preferred embodiments, the bit breaker 10 is devoid of a manual or powered actuator configured to move any jaw 300, 305 of the bit breaker, or is at least devoid of any such actuator configured to move either or both jaws relative to the plate 100. This can optionally be the case for any embodiment of the present disclosure. For example, the bit breaker 10 preferably does not have a lever or a hydraulic or pneumatic actuator configured to move either or both of the two illustrated jaws 300, 305 relative to the plate 100. Thus, the bit breaker 10 preferably is devoid of any hydraulic or pneumatic cylinder configured to move either jaw or both jaws, or is at least devoid of any hydraulic or pneumatic cylinder configured to move either or both jaws relative to the plate 100.

The bit breaker 10 can optionally have one or more handles 400. When provided, the handles 400 can project outwardly from the plate 100, such as from its top planar surface 120, as shown in FIG. 1. In embodiments of this nature, the plate 100 can optionally include a recessed area 405 below each of the handles 400 to facilitate grasping the handles 400 and carrying the bit breaker 10. Alternatively, the handles can be defined by recesses (e.g., channels) formed in the sides of the plate 100 and sized to facilitate manual handling of the bit breaker 10. Moreover, the bit breaker can alternatively have no handles. Preferably, the bit breaker 10 has two handles 400, although a single handle 400 or more than two handles 400 can be provided. In preferred embodiments, the two handles 400 are located respectively alongside two jaws 300, 305. For example, two jaws 300, 305 can be located between the two handles 400. Preferably, each of the two handles 400 is elongated in a direction that is at least generally parallel to two axes along which the two jaws 300, 305 are respectively elongated.

When provided, the two handles 400 can optionally be mounted to the plate 100 so as to have a limited degree of freedom to move upwardly and downwardly relative to the plate. Thus, the illustrated handles 400, when grasped by an operator who wishes to pick up the bit breaker, can slide a certain distance upwardly relative to the plate so as to provide clearance for the operator's hands between the handles and the plate. This can advantageously allow the operator to comfortably grab the handles when lifting the bit breaker.

When provided, the handles can be mounted to the plate using various conventional fasteners, such as bolts. If desired, the handles can be welded in fixed positions on the plate. In the embodiments illustrated, each end of each handle 400 is attached (e.g., welded) to a head 1405 having a larger diameter than the handle, and each handle end and the head 1405 attached thereto is received in a countersunk bore 1410 extending upwardly through the plate 10. This is best appreciated with reference to FIGS. 5 and 13. These details, however, are by no means required.

The plate 100 preferably comprises (e.g., consists essentially of, or consists of) metal, such as steel. Similarly, the (or each) jaw 300, 305 preferably comprises (e.g., consists essentially of, or consists of) metal, such as steel. The bushings 510, jaw(s) 300, 305, and/or plate 100 can optionally include a surface coating to improve wearability. Preferably, the plate 100 and the jaw(s) 300, 305 are formed of steel, although other metals or certain non-metal materials (e.g., ceramic or a desired composite) can be used.

In certain embodiments, the jaw or jaws 300, 305 are formed of a softer material (optionally a softer metal) than the plate 100. In some cases, both the plate and the jaw or jaws are formed of metal, and the jaw or jaws are formed of a softer metal than the plate. The jaw or jaws, for example, can be formed of a first type of steel, while the plate is formed of a second type of steel, with the first type of steel being softer than the second type of steel. In some cases, carbon steel may be used for the jaw(s) while abrasion resistant ("AR") carbon steel is used for the plate. If desired, the jaw or jaws may be formed of a polymer or composite material, such as a metal-polymer composite, while the plate is formed of metal, e.g., steel.

In other embodiments, the jaw or jaws 300, 305 are formed of a harder material (optionally a harder metal) than the plate 100. In some cases, both the plate and the jaw or jaws are formed of metal, and the jaw or jaws are formed of a harder metal than the plate. The jaw or jaws, for example, can be formed of a first type of steel, while the plate is formed of a second type of steel, with the first type of steel being harder than the second type of steel. In other cases, the plate and the jaws are formed of the same type of steel, but the jaws are hardened whereas the plate is not. Alternatively, the plate and the jaw or jaws can be formed of the same material, e.g., so as to have the same hardness. In some embodiments of this nature, the plate and the jaw(s) are each formed of the same A514 steel (e.g., ASTM A514-T1).

In the embodiments illustrated, a perimeter 170 of the plate 100 defines an exterior shape of the bit breaker 10. As shown in the drawings, the bit breaker 10 can optionally have a generally square exterior shape. However, it should be noted that the bit breaker 10 can have various other exterior shapes and is not limited to the square exterior shape shown in the drawings. In some cases, the bit breaker is generally flat, rather than being configured as a box, cage, or housing.

The illustrated bit breaker 10, and more specifically the illustrated plate 100, has four corners 175, 180, 185, 190. Each corner 175, 180, 185, 190 of the illustrated bit breaker 10 has a pin-locator hole 500 formed therein (or adjacent thereto). In such cases, each pin-locator hole 500 is configured to receive a respective pin for mounting the plate 100 to a working surface 45 (see FIG. 17). When the bit breaker 10 is mounted operatively on the working surface 45, the pins orient the bit breaker 10 in a desired, fixed position. If desired, the bit breaker 10 when so mounted may lie in a generally horizontal plane. This is the case in FIG. 17. As illustrated, the working surface 45 can optionally be defined by a mounting table or another mounting structure. The pins can project upwardly from the working surface 45. Additionally or alternatively, the working surface 45 can include threaded bores configured to respectively receive the pins therein.

While the illustrated bit breakers 10 each have four pin-locator holes 500 located in four corners of the plate 10, there can alternatively be more or fewer pin-located holes. More generally, the bit breaker may have two or more pin-locator holes positioned at various different locations on the plate. Furthermore, it is possible to eliminate the pin-locator holes from the plate, and instead provide other means on the mounting table to secure the bit locator in a stationary position.

The plate of a conventional plate bit breaker has four pin-location holes to receive four pins that anchor the bit breaker to a mounting table. With conventional bit breaker designs of that type, rotation of the pipe, tool section, tool or pipe joint 20 generates force on the pins in the pin-locator holes 500. Eventually, this can cause the pin-locator holes 500 to become oblong or otherwise enlarged. That can result in the bit breaker no longer being stably mountable in a stationary position on the mounting table. Eventually, such deformation may cause the plate to be discarded.

Figure 19A:
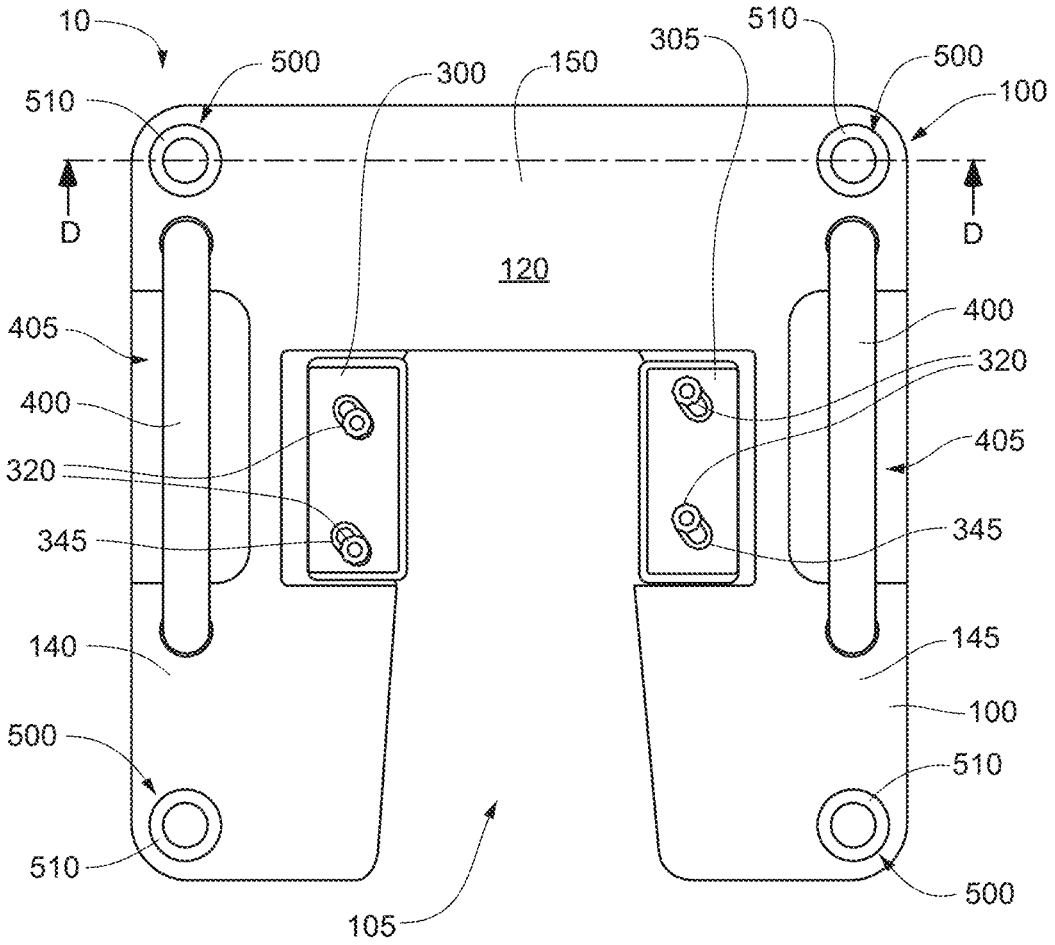
FIG. 19A is a top view of a bit breaker in accordance with certain embodiments of the present disclosure wherein pin-locator holes are formed in a plate of the bit breaker, and replaceable bushings are mounted removably in the pin-locator holes.
Figure 19B:
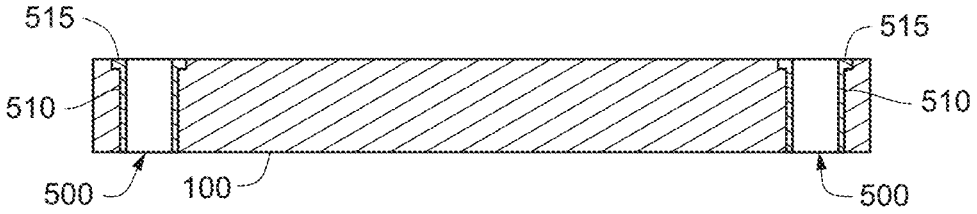
FIG. 19B is a cross-sectional view taken along line D-D of FIG. 19A, showing two of the replaceable bushings mounted in their respective pin-locator holes.

In certain embodiments, the present disclosure overcomes this problem by providing replaceable bushings 510 that are mounted removably in respective pin-locator holes 500 (see FIGS. 19A and 19B). In such embodiments, when the replaceable bushings 510 become worn, they can simply be removed from the pin-locator holes 500 and thereafter replaced with new bushings 510. This enables continued use of bit breaker 10 even after the bushings 510 have become worn or damaged. The bushings 510 can optionally be secured in the pin-locator holes 500 by a compression fit, a geometrical fit, and/or a mechanical fastener. Each bushing 510 can optionally be received in its respective pin-locator hole 500 such that a top 515 of the bushing 510 is substantially flush with, or at least substantially parallel to, the top face 120 of the plate 100. The removable nature of the bushings 510 also allows the size of the bushings 510 to be changed so as to accommodate pins of different sizes.

When provided, the replaceable bushings 510 can optionally be formed of a different material than the plate 100. For example, they may be formed of a softer material than the plate 100. In some cases, both the plate 100 and the replaceable bushings 510 are formed of metal, and the replaceable bushings are formed of a softer metal than the plate. In some cases, the replaceable bushings are formed of brass, while the plate is formed of steel. In other cases, the replaceable bushings are formed of a first type of steel, while the plate is formed of a second type of steel, with the first type of steel being softer than the second type of steel. If desired, the replaceable bushings may be formed of a polymer or composite material, such as a metal-polymer composite, while the plate is formed of metal, e.g., steel.

In other embodiments, the replaceable bushings 510 are formed of a harder material (optionally a harder metal) than the plate 100. In some cases, both the plate and the bushings are formed of metal, and the bushings are formed of a harder metal than the plate. The bushings, for example, can be formed of a first type of steel, while the plate is formed of a second type of steel, with the first type of steel being harder than the second type of steel. In other cases, the plate and the bushings are formed of the same type of steel, but the bushings are hardened whereas the plate is not. Alternatively, the plate and the bushings can be formed of the same material, e.g., so as to have the same hardness.

While the illustrated plate 100 has four pin-locator holes 500, there can be fewer (e.g., two or three) or there can be more (e.g., five or more). Furthermore, in the present embodiments, two or more pin-locator holes, each equipped with a removable bushing, can be provided at various different locations on the plate.

In some embodiments, the jaw or jaws 300, 305 and/or the optional bushings 510 have a coating, such as an anti-galling coating. In such cases, the plate can optionally be devoid of such a coating (e.g., the plate can optionally be uncoated). As one example, a coating comprising a phosphate, such as manganese phosphate, can be provided. Coatings of this nature can be applied by well-known processes, or can be purchased commercially from various coating providers, such as Metal Coatings Corp. of Houston, Tex., USA.

In certain embodiments, the invention provides an assembly 60 of a bit breaker 10 and a pipe, tool section, tool or pipe joint 20. In the present assembly, the pipe, tool section, tool or pipe joint 20 is received in the pipe slot 105 of the bit breaker 10. Reference is made to FIG. 17. In the present assembly, the pipe, tool section, tool or pipe joint 20 is of the type described above, i.e., where two crosswise flat-bottom grooves 25 are located on opposite sides 30, 35 of the pipe, tool section, tool or pipe joint 20. The two removable jaws of the bit breaker are received respectively in two flat-bottom grooves of the pipe, tool section, tool or pipe joint, e.g., such that the two working surfaces of the two jaws are generally parallel to, and bear respectively against, the two flat bottoms of the two flat-bottom grooves.

In the present assembly, the two jaws 300, 305 preferably are the only portions of the bit breaker 10 that are in contact with the pipe, tool section, tool or pipe joint 20. It is to be appreciated, however, that this is by no means limiting to the invention. For example, a surface of the plate 100 bounding the rear of the pipe slot 105 may contact the pipe, tool section, tool or pipe joint 20 in some cases.

In some cases, the working surfaces 310, 315 of two jaws 300, 305 contact the two flat bottoms 40 of the two flat-bottom grooves 25 along more than 10% of the length thereof, such as more than 20%, more than 30%, more than 50%, or even more 75% of the length thereof. In some cases, the percentage of contact is 90% or more, or even 100% (or at least about 100%). Here, the specified percentage of contact refers to the length of a flat-bottom groove and the segment (or portion) of that length that is contacted by one or more areas of the working surface of a respective jaw of the bit breaker. Arrangements of this nature advantageously result in force from the pipe, tool section, tool or pipe joint 20 being distributed over a greater length of the jaws 300, 305 (i.e., over a greater area of the working surface of each jaw). It is to be appreciated, however, that the percentages of contact noted in this paragraph, while preferred, are not required.

If a working surface has a series of teeth that each come to a point, and those teeth contact the flat-bottom groove at points that are spaced-apart along the entire length of the flat-bottom groove, the percentage of contact is to be considered 100%, even though there will be areas between each pair of adjacent teeth that do not provide contact. The same is true if recesses are formed in the working surface of a jaw.

In some cases, the working surfaces 310, 315 of two jaws 300, 305 contact the two flat bottoms 40 of the two flat-bottom grooves 25 along up to 50% of the length thereof. In other cases, the working surfaces 310, 315 of two jaws 300, 305 contact the two flat bottoms 40 of the two flat-bottom grooves 25 along more than 50% of the length thereof.

Further, certain embodiments of the invention provide a threaded joint between an upper component (e.g., an upper length of a pipe, tool section, tool or pipe joint) and a lower component (e.g., a lower length of a pipe, tool section, tool or pipe joint). In the present embodiments, the lower component has two flat-bottom grooves in which two removable jaws of the bit breaker preferably are received respectively. The lower component preferably is received in the pipe slot of the bit breaker, e.g., such that the two working surfaces of the two jaws are generally parallel to, and bear respectively against, the two flat bottoms of the two flat-bottom grooves in the lower component.

To loosen the present joint, the upper component is rotated in a first direction (e.g., counterclockwise), and the bit breaker prevents the lower component from rotating substantially in the first direction (e.g., holds the lower component stationary). To make the present joint, the upper component is rotated in a second direction (e.g., clockwise), and the bit breaker prevents the lower component from rotating substantially in the second direction (e.g., holds the lower component stationary). In such cases, the percentages of contact noted above preferably occur. The invention also extends to such methods of making, and loosening, the present joint in the manner described above. These methods can involve using a bit breaker in accordance with any embodiment described herein.

Thus, some of the embodiments described above provide a bit breaker having at least one jaw configured to move relative to the plate.

One group of embodiments provides a bit breaker 10 comprising a plate 100 (e.g., a generally or substantially flat plate) that bounds a pipe slot 105. In the present embodiment group, the bit breaker 10 has two jaws 300, 305 that define two working surfaces 310, 315 located on opposite sides of the pipe slot 105. The two jaws 300, 305 are configured to move relative to the plate 100. Preferably, the two jaws 300, 305 are configured to move relative to the plate 100 in response to a pipe, tool section, tool or pipe joint 20 rotating in the pipe slot 105 against the two working surfaces 310, 315 of the two jaws. In more detail, the two jaws 300, 305 preferably are configured to move relative to the plate 100 in response to the pipe, tool section, tool or pipe joint 20 rotating in the pipe slot 105 such that flat bottoms of two flat-bottom grooves of the pipe, tool section, tool or pipe joint 20 bear respectively against the two working surfaces 310, 315 of the two jaws.

Preferably, the bit breaker 10 is devoid of a hydraulic or pneumatic actuator configured to move either of the two jaws 300, 305, or at least is devoid of a hydraulic or pneumatic actuator configured to move (e.g., pivot or otherwise rotate) either of the two jaws 300, 305 relative to the plate 100.

Figure 24:
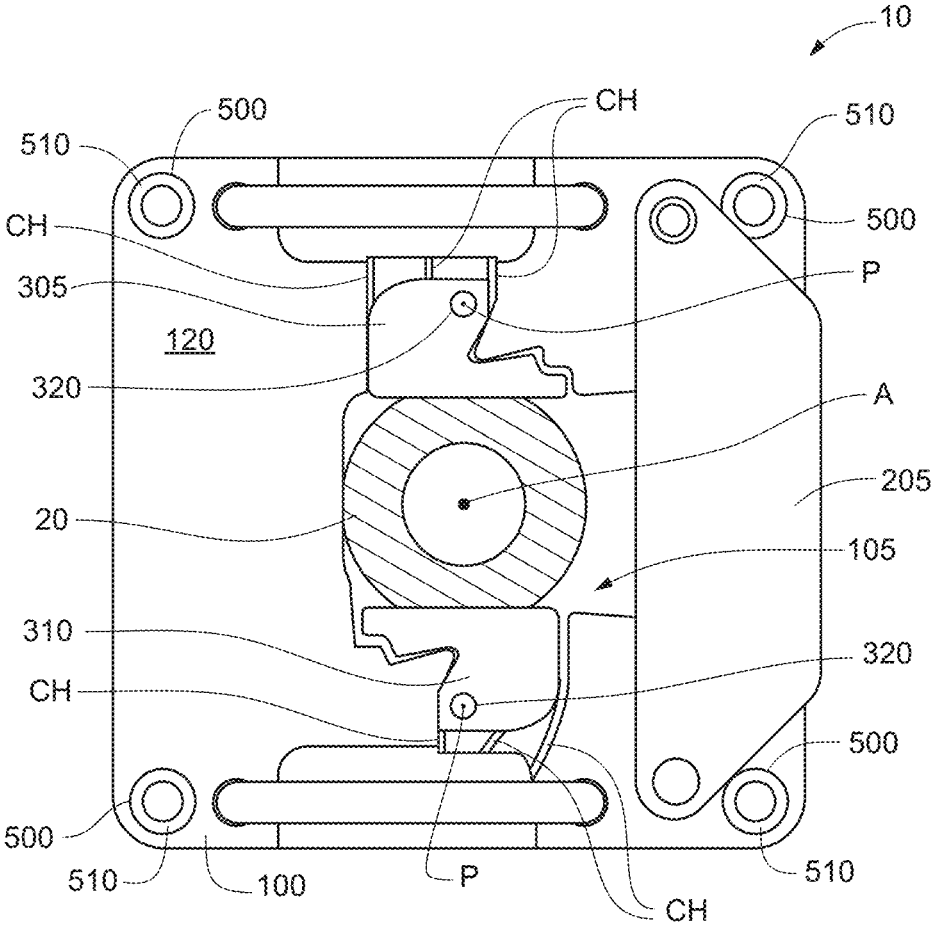
FIG. 24 is a top view of the bit breaker of FIG. 21 with a pipe received in a pipe slot of the bit breaker in accordance with certain embodiments of the invention, and two jaws of the bit breaker each shown in a release position.
Figure 25:
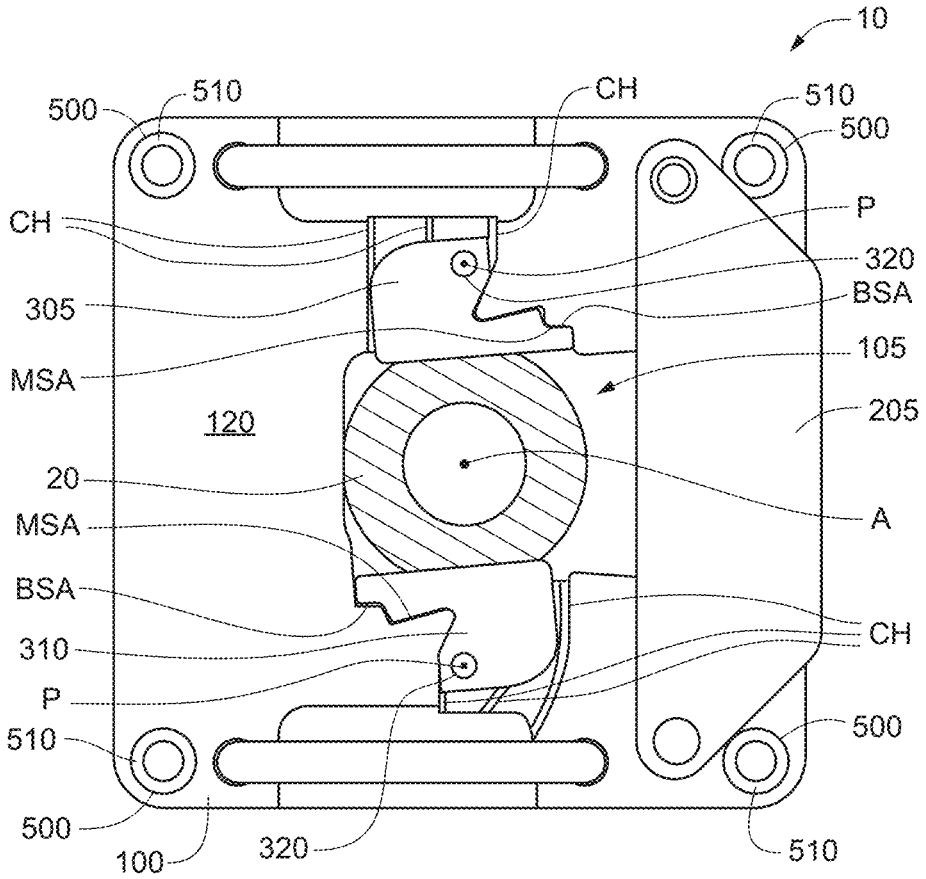
FIG. 25 is a top view of the bit breaker of FIG. 21, with a pipe received in a pipe slot of the bit breaker in accordance with certain embodiments of the invention, and two jaws of the bit breaker each shown in an engage position.

In the present group of embodiments, each of the two jaws 300, 305 preferably has an engage position and a release position. Each jaw is positioned (e.g., oriented) differently when in the engage position than when in the release position. This is perhaps best appreciated by referring to FIGS. 24 and 25. FIG. 24 shows each of the two jaws 300, 305 in a release position, whereas FIG. 25 shows each of the two jaws in an engage position.

Each of the two jaws 300, 305 is moveable (e.g., relative to the plate 100) between the release position and the engage position. The jaws can optionally be rotatable between the release position and the engage position. This can be appreciated by comparing FIGS. 24 and 25.

Figure 23:
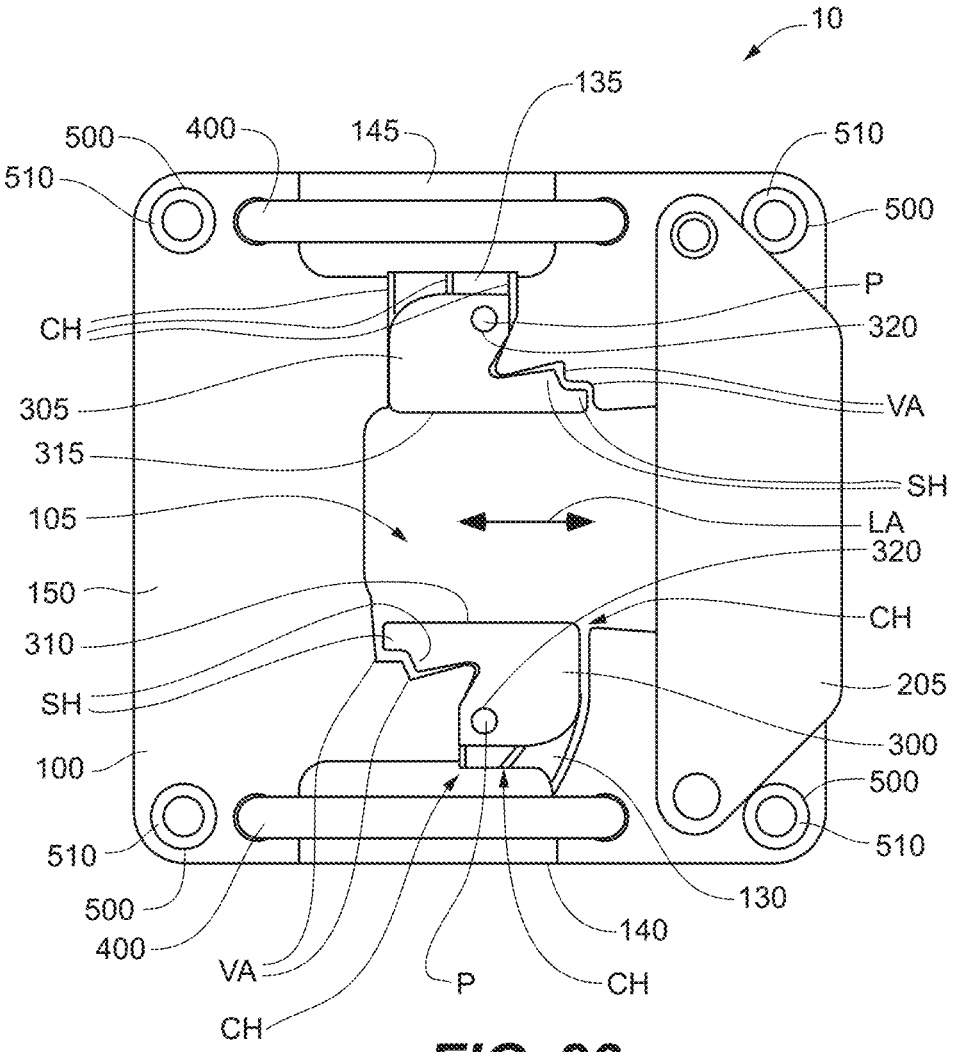
FIG. 23 is a top view of the bit breaker of FIG. 21.

Preferably, when each of the two jaws 300, 305 is in the release position, a pipe, tool section, tool or pipe joint 20 can move freely (e.g., along axis LA) within the pipe slot 105 of the bit breaker 10 (e.g., by virtue of moving the bit breaker laterally relative the pipe, tool section, tool or pipe joint). Reference is made to FIGS. 23 and 24. When the jaws 300, 305 are each in the engage position, the working surfaces 310, 315 of the two jaws 300, 305 are positioned to engage or engage (i.e., are positioned to contact or contact, such as by embracing opposite sides of) a pipe, tool section, tool or pipe joint 20 that is located in the pipe slot 105 of the bit breaker. Preferably, when the jaws 300, 305 are in the engage position, their working surfaces 310, 315 are positioned to provide (or provide) a percentage of contact within any one or more of the ranges noted above.

If desired, the two jaws 300, 305 can each be configured to (e.g., mounted on the plate so as to) pivot or otherwise rotate relative to the plate 100. In some embodiments of this nature, each jaw is configured to rotate (optionally by no more than 10 degrees, such as no more than 5 degrees, or even less than 3 degrees) when it moves from the release position to the engage position or vice versa. In embodiments where the jaws 300, 305 are pivotable or otherwise rotatable, they preferably are free rotate (e.g., relative to the plate) independently of each other.

In the present embodiment group, each of the two jaws 300, 305 can optionally be pivotal between the engage position and the release position. Thus, in the embodiment of FIGS. 24 and 25, each jaw 300, 305 is mounted pivotally to the plate 100, e.g., so as to have a limited range of freedom to pivot relative to the plate. This range of freedom to pivot can optionally be no more than 10 degrees, such as no more than 5 degrees, or even less than 3 degrees.

In some embodiments of the present group, the two jaws 300, 305 respectively have two pivot points P that are directly aligned, and/or directionally aligned, with each other across the pipe slot 105. In this context, by saying "directly aligned" we mean that an imaginary straight line extending laterally (i.e., perpendicular to the longitudinal axis LA) across the bit breaker starting from the pivot point P of one of the two jaws will at least pass through some portion of the pin or other fastener 320 defining the pivot point P of the other of the two jaws. Preferably, the imaginary straight line will pass through both pivot points P. By saying "directionally aligned," we mean the pivot points P of the two jaws 300, 305 are either perfectly aligned with each other (i.e., both lie on the same axis extending laterally across the bit breaker) or offset from being perfectly aligned with each other by no more than ½ inch.

As will be appreciated, in some assemblies that will be present during use, the bit breaker 10 will be positioned such that a pipe, tool section, tool or pipe joint 20 is received in the pipe slot 105 of the bit breaker. One non-limiting example of a bit breaker 10 so positioned is shown in FIGS. 24 and 25. As will be appreciated, the pipe, tool section, tool or pipe joint 20 is has a longitudinal axis A. In some cases, the two jaws 300, 305 are engaged with (e.g., embrace) the pipe, tool section, tool or pipe joint 20 such that the longitudinal axis A of the pipe, tool section, tool or pipe joint 20 is directly aligned with the pivot points P of both jaws. In this context, by saying "directly aligned," we mean that an imaginary straight line passing through the longitudinal axis A of the pipe, tool section, tool or pipe joint 20 and extending laterally across the bit breaker will at least pass through some portion of each of the two pins or other fasteners 320 respectively defining the pivot points P of the two jaws. Preferably, the imaginary straight line will actually pass through the pivot points P of the two jaws 300, 305.

In some of the present embodiments, each of the two jaws 300, 305 has a pivot point P comprising and/or defined by a pin or other fastener 320 extending from one of the two jaws to the plate 100 and received in a bore so as to be rotatable therein. In such cases, the pin or other fastener 320 can optionally be restrained against axial movement, or at least against substantial axial movement. Preferably, each pin or other fastener 320 is mounted to the plate 100 and connected to a respective jaw 300, 305 so that the jaw is prevented from being removed from the plate, at least without disassembling or breaking the jaw subassembly.

Thus, in certain embodiments, each jaw subassembly comprises one of the two jaws 300, 305 and a corresponding pin or other fastener 320. Each such jaw subassembly can optionally include a spring clip or other anchor SC configured to retain the jaw on the plate 100 while providing the jaw with at least a limited range of freedom to rotate relative to the plate. When provided, the spring clip or other anchor SC preferably is configured to be removed and reassembled from/onto the plate repeatedly. In some cases, the bit breaker 10 includes (e.g., optionally has only) two jaw subassemblies, which are mounted to the plate 100 on opposite sides of the pipe slot 105.

In certain embodiments of the present group, the engage position and the release position are separated by less than 0.5 inch. In some cases, the engage position and the release position are separated by a distance in a range of 0.1-0.26 inch, such as about 0.18 inch. By saying the engage position and the release position are separated by a certain distance, we refer to the displacement of the point or points on each jaw where the maximum displacement occurs when the jaw is moved from the release position to the engage position or vice versa. It is to be appreciated that the ranges noted in this paragraph are by no means required. For example, the extent to which the engage and release positions are separated can be varied, such as to accommodate different dimensions and designs of the bit breaker and the pipe, tool section, tool or pipe joint. For any embodiment of the present disclosure, however, the engage position and the release position can optionally be separated by a distance in any one or more of the ranges (e.g., both ranges) noted in this paragraph.

In some cases, the working surfaces 310, 315 of the two jaws 300, 305 are parallel (or at least generally or substantially parallel) to each other when either both jaws are in the release position or both jaws are in the engage position. This can optionally be the case in any embodiment of the present disclosure.

Preferably, the plate 100 includes two front regions 100FR that bound a mouth of the pipe slot 105. This can be appreciated, for example, by referring to FIG. 22. Here, the two front regions 100FR of the plate 100 define two confronting mouth surfaces 100MS. Preferably, one or each of the two confronting mouth surfaces 100MS is more flush and/or more continuous with the adjacent jaw working surface 310, 315 when the jaws are in the release position than when the jaws are in the engage position. Reference is made to FIGS. 24 and 25.

In the present group of embodiments, the two working surfaces 310, 315 of the two jaws 300, 305 preferably are each devoid of any concave (e.g., semicircular) recess configured to receive a pipe, tool section, tool or pipe joint 20. In more detail, each of the working surfaces 310, 315 preferably is elongated along (and optionally flush with) a line that is straight or at least substantially straight. This can optionally be the case for more than 50% (or even more than 75%) of the length of each working surface 310, 315. Thus, the two jaws 300, 305 preferably do not have (i.e., are devoid of) arcuate configurations that match an outside (or "outer") radius of the pipe, tool section, tool or pipe joint.

In some embodiments of the present group, each of the two jaws 300, 305 has a bearing surface BSA that is engaged with (e.g., is in contact with) a corresponding mating surface MSA of the plate 100 when the two jaws are in the engage position. Reference is made to FIG. 25. The bearing surface BSA of each jaw 300, 305 can optionally comprise a shoulder SH configured to bear against a valley VA of the corresponding mating surface MSA of the plate 100. In certain embodiments, the bearing surface BSA of one or each jaw comprises two shoulders SH configured to bear against two respective valleys VA of the corresponding mating surface MSA of the plate 100. This is perhaps best appreciated by referring to FIGS. 23-26

In some cases, the bearing surface BSA of one or each jaw has a serpentine configuration. In such cases, the corresponding mating surface(s) MSA of the plate preferably has a complimentary serpentine configuration. Additionally or alternatively, the bearing surface BSA of one or each jaw can have a zig zag-shaped or stair-like (or "step-like") configuration. In such cases, the corresponding mating surface(s) MSA of the plate preferably has a complimentary zig zag-shaped or stair-like (or "step-like") configuration.

As noted above, the bit breaker 10 can be positioned such that a pipe, tool section, tool or pipe joint 20 is received in the pipe slot 105 of the bit breaker. In such cases, the two jaws 300, 305 preferably can be engaged with the pipe, tool section, tool or pipe joint 20 such that each of the two jaws is in the engage position and has its working surface 310, 315 in contact with a flat bottom surface 40 of a crosswise groove 25 formed in the pipe, tool section, tool or pipe joint over a first contact surface area. In embodiments of this nature, each of the two jaws 300, 305 preferably has a bearing surface BSA that is engaged with (e.g., is in contact with) a corresponding mating surface MSA of the plate 10 over a second contact surface area. In such cases, the second contact surface area can optionally be equal to or greater than the first contact surface area. For example, the second contact surface area can optionally be greater than (e.g., at least 10% greater than, at least 20% greater than, or at least 25% greater than) the first contact surface area.

The illustrated bearing surfaces BSA and the corresponding mating surfaces MSA of the plate 100 are perpendicular to the top face 120 of the plate 100. If desired, however, these surfaces can be provided at various non-perpendicular angles. Providing such corresponding angles and/or other more complex corresponding geometries can increase the contact surface area between such bearing surfaces BSA and the corresponding mating surfaces MSA.

In the present embodiment group, the plate 100 can optionally be formed of a different material than the two jaws 300, 305. For example, the two jaws may be formed of a softer material than the plate. In some cases, both the plate and the jaws are formed of metal, and the jaws are formed of a softer metal than the plate. The jaws, for example, can be formed of a first type of steel, while the plate is formed of a second type of steel, with the first type of steel being softer than the second type of steel. If desired, the jaws may be formed of a polymer or composite material, such as a metal-polymer composite, while the plate is formed of metal, e.g., steel.

In other cases, the jaws 300, 305 are formed of a harder material (optionally a harder metal) than the plate 100. This can optionally be in combination with the above-noted second contact surface area being greater than (e.g., at least 10% greater than, at least 20% greater than, or at least 25% greater than) the above-noted first contact surface area. If desired, both the plate and the jaws can be formed of metal, and the jaws are formed of a harder metal than the plate. The jaws, for example, can be formed of a first type of steel, while the plate is formed of a second type of steel, with the first type of steel being harder than the second type of steel. In still other cases, the plate and the jaws are formed of the same type of steel, but the jaws are hardened whereas the plate is not. Alternatively, the plate and the jaws can be formed of the same material, e.g., so as to have the same hardness.

In some embodiments of the present group, the jaws 300, 305 and/or the optional bushings 510 have a coating, such as an anti-galling coating. In such cases, the plate 100 can optionally be devoid of such a coating (e.g., the plate can optionally be uncoated). As one example, a coating comprising a phosphate, such as manganese phosphate, can be provided. Coatings of this nature can be applied by well-known processes, or can be purchased commercially from various coating providers, such as Metal Coatings Corp. of Houston, Tex., USA.

The bit breaker 10 of the present embodiment group can optionally further include an adjustable arm 205 having a closed position and an open position. When the adjustable arm 205 is in its closed position, the pipe slot 105 is surrounded about 360 degrees by the bit breaker. When the adjustable arm 205 is in its open position, the pipe slot 105 has an open side that enables the bit breaker to be removed from a pipe, tool section, tool or pipe joint 20 received in the pipe slot by moving the bit breaker laterally relative to (e.g., apart from) the pipe, tool section, tool or pipe joint. In some cases, the plate 100 comprises a single, generally flat body that entirely surrounds three sides of the pipe slot 105, and when the adjustable arm 205 is in its closed position the adjustable arm bounds the pipe slot on a fourth side thereof.

In the present group of embodiments, the plate 100 preferably defines two fixed arms 140, 145 and a fixed base leg 150. In more detail, the two fixed arms 140, 145 preferably project respectively from opposed ends of the fixed base leg 150. In such cases, the plate 100 may have a generally U-shaped configuration. The two fixed arms 140, 145 can have two respective free ends to which two opposed ends of the optional adjustable arm 105 are respectively mounted when the adjustable arm is in its closed position.

In some of the present embodiments, the two jaws 300, 305 are mounted respectively to two fixed arms 140, 145 of the plate 100, and the two fixed arms are non-adjustable such that relative positions of the two fixed arms and a fixed base leg are fixed. In such cases, the pipe slot 105 preferably has a width that is non-adjustable in that a distance between the two fixed arms 140, 145 is fixed.

In the embodiments illustrated, the bit breaker 10 has four corners, each of the corners preferably has a pin-locator hole 500 formed therein, and four replaceable bushings 510 preferably are mounted removably in the four respective pin-locator holes. In such embodiments, when the replaceable bushings 510 become worn, they can simply be removed from the pin-locator holes 500 and thereafter replaced with new bushings 510. This enables continued use of the bit breaker 10 even after the bushings 510 have become worn or damaged. The bushings 510 can optionally be secured in the pin-locator holes 500 by a compression fit, a geometrical fit, and/or a mechanical fastener. Each bushing 510 can optionally be received in its respective pin-locator hole 500 such that a top 515 of the bushing 510 is substantially flush with, or at least substantially parallel to, the top face 120 of the plate 100. The removable nature of the bushings 510 may allow the size of the bushings to be changed to accommodate pins of different sizes.

While four bushings are illustrated, the bit breaker can take different forms and can thus be provided with a different number of bushings. Moreover, it is by no means required that the bit breaker be provided with any replaceable bushings whatsoever.

In any embodiment of the present disclosure, the bit breaker 10 can optionally have a debris management structure. When provided, the debris management structure preferably includes one or more (e.g., a plurality of) channels CH formed in the plate 100. When provided, one or more such channels may extend beneath each of the two jaws 300, 305. This is perhaps best appreciated by referring to FIGS. 23, 24, and 25. In some cases, beneath each of the two jaws 300, 305 there is at least one such channel CH. In addition, alongside at least one (optionally alongside each) of the two jaws there can optionally be at least one other channel CH of the plurality of channels. When provided, this side channel (or these side channels) can optionally be fully exposed (e.g., not concealed beneath a jaw), at least when the jaws are in the release position. Reference is made to FIG. 23. In some cases, each of the two jaws 300, 305 has one or more (e.g., at least two) channels CH that are each located in part beneath the jaw while another part of each such channel extends beyond the jaw (so as to be exposed). This is best appreciated by referring to FIGS. 23-25.

In embodiments where the bit breaker 10 has a debris management structure, this structure may be defined, at least in part, by two optional connection ledges 130, 135 of the plate 100. In some cases, one or more (e.g., at least two, or at least three) channels CH are formed in each such connection ledge. Thus, the channels CH can optionally all be provided at locations spaced from (e.g., below) the top face 120 of the plate 100.

Figure 26:
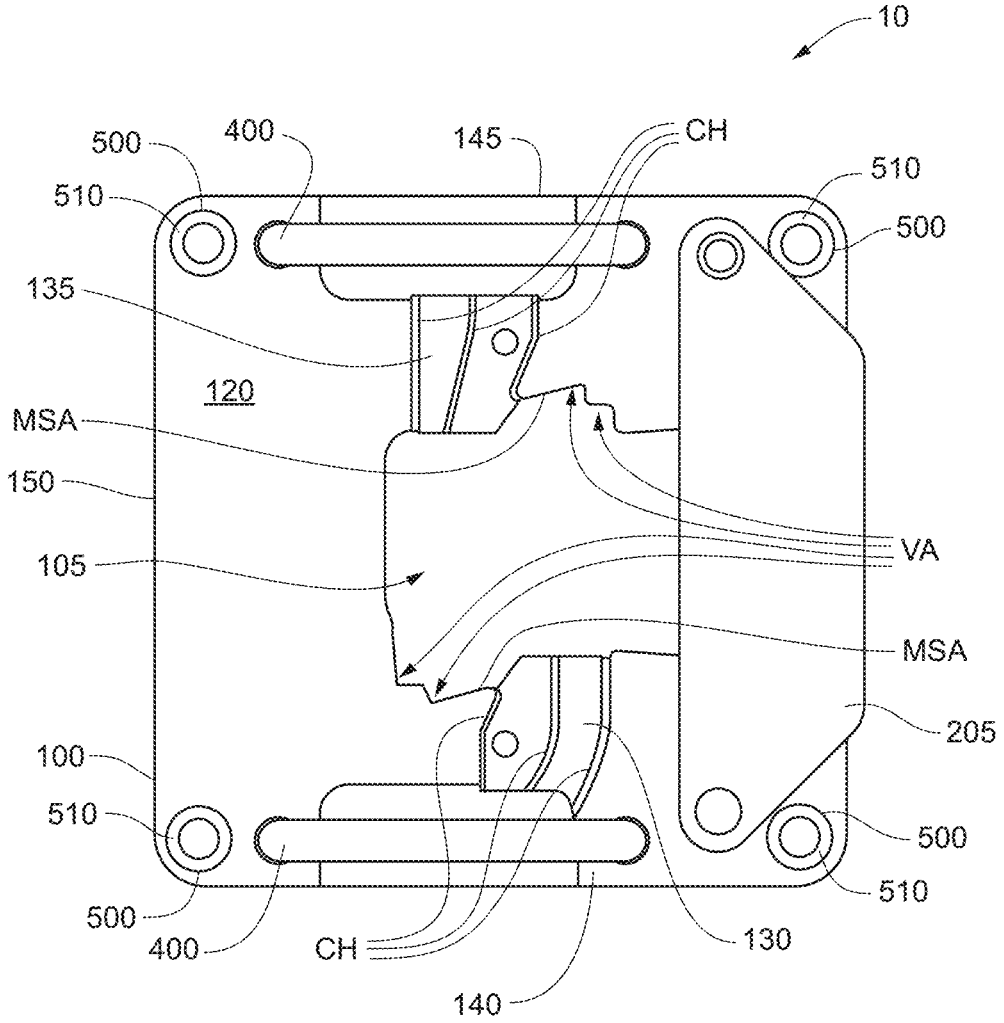
FIG. 26 is a top view of the bit breaker of FIG. 21, with two jaws of the bit breaker removed.
Figure 27:
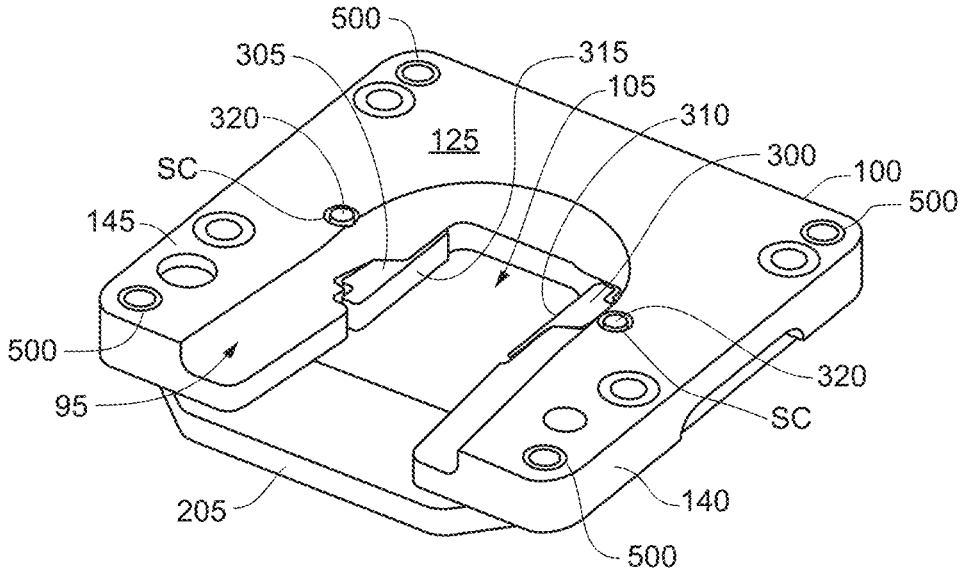
FIG. 27 is a bottom perspective view of the bit breaker of FIG. 21.
Figure 28:
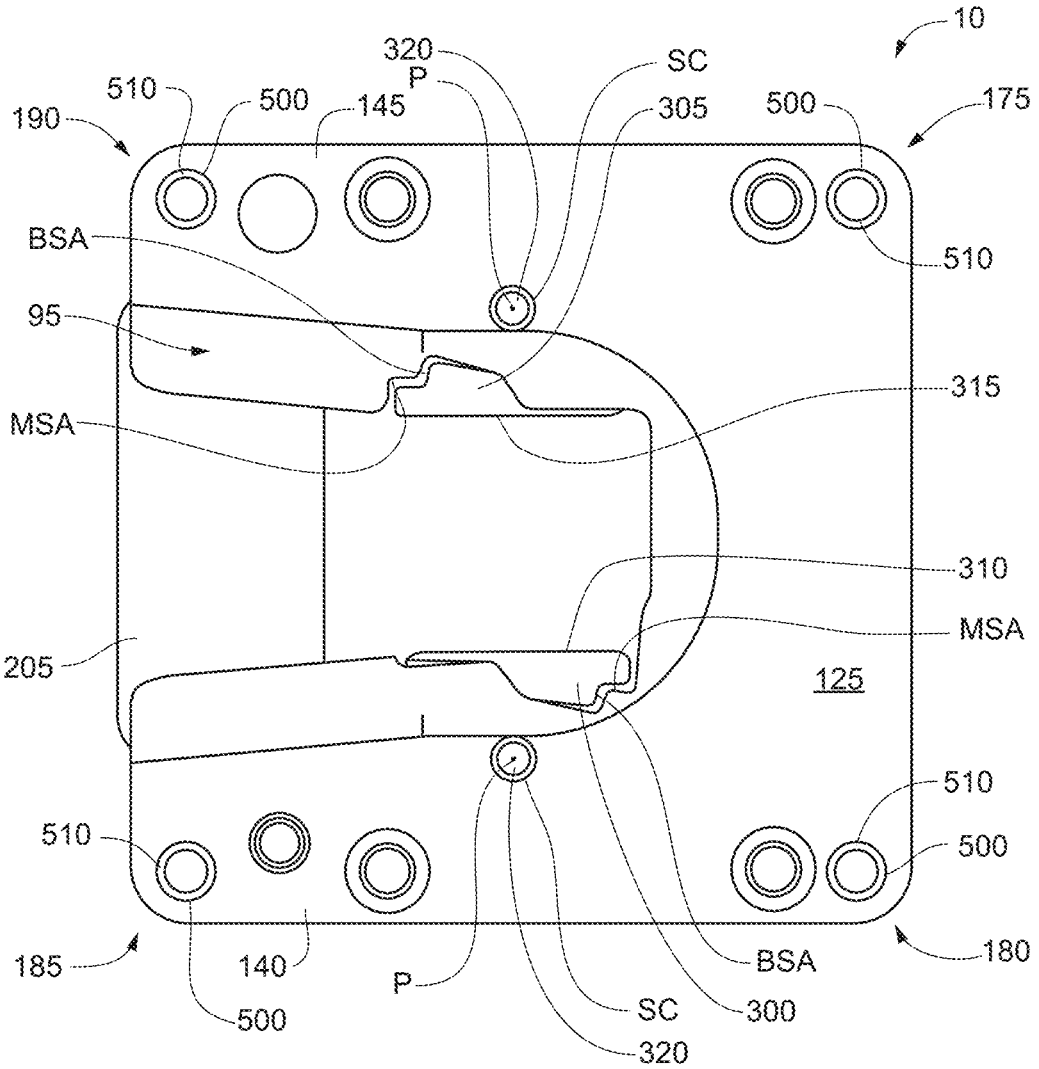
FIG. 28 is a bottom view of the bit breaker of FIG. 21.
Figure 29:
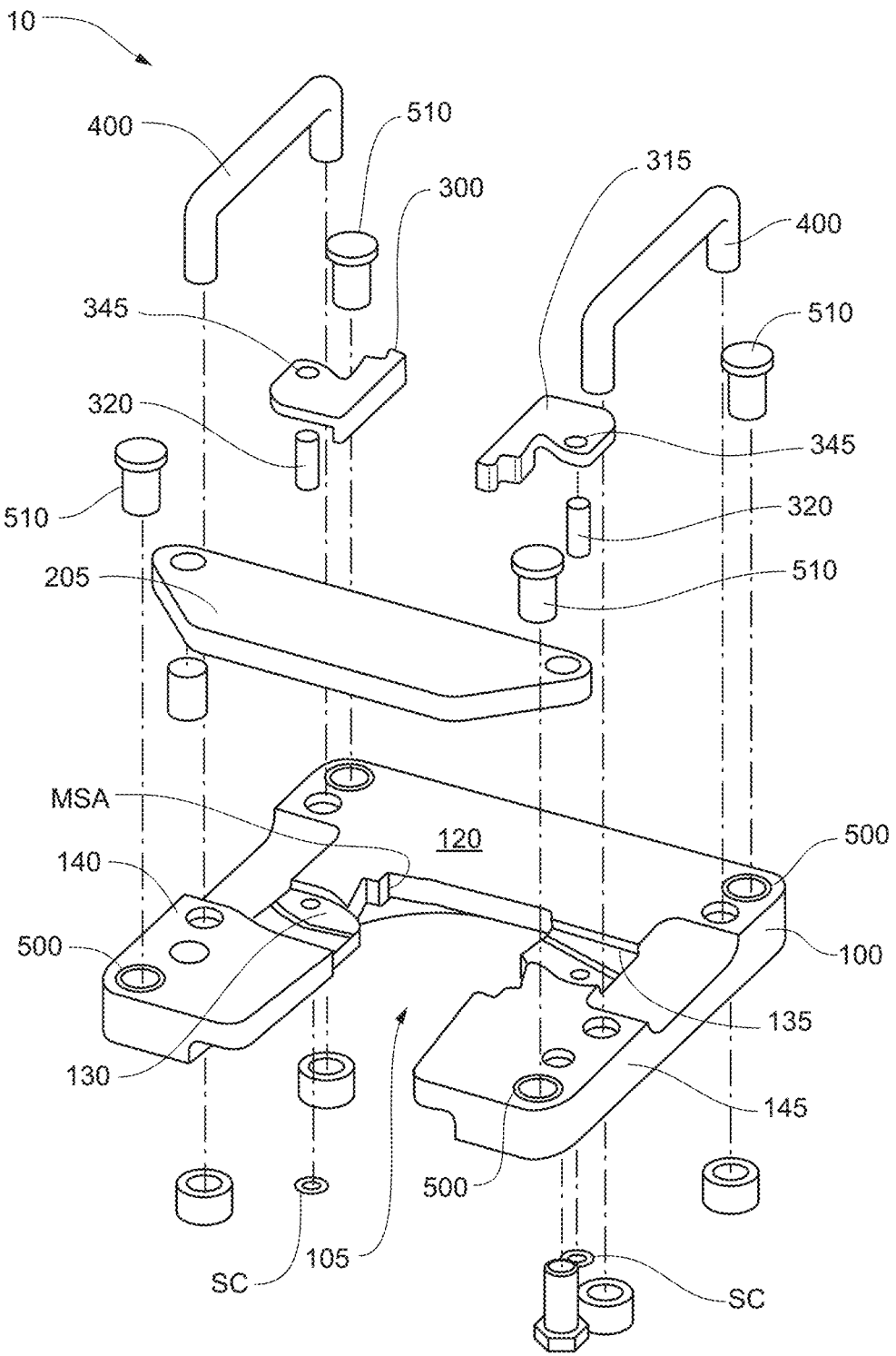
FIG. 29 is an exploded view of the bit breaker of FIG. 21.

FIG. 26 shows the bit breaker of FIGS. 21-25 with the jaws 300, 305 removed. In this particular non-limiting arrangement of a debris management structure, three channels CH are provided in each connection ledge 130, 135. This exemplifies embodiments wherein the debris management structure has one or more channels with a curved or angled configuration and one or more channels with a straight configuration. Alternatively, all the channels can be straight, or all the channels can be curved, angled, or both.

When provided, one or more channels (e.g., each channel) CH of the optional debris management structure can be open to the pipe slot 105. Additionally or alternatively, one or more channels (e.g., each channel) CH of the optional debris management structure can be open to a handle recess 405, which when provided may open through a lateral side of the plate. The debris management structure can include, for example, two or more (three or more, four or more, or even five or more) channels CH that each extend from the pipe slot 105, beneath a respective one of the two jaws 300, 305, and to a handle recess 405 or a lateral side of the plate 100. It is to be appreciated, however, that the debris management system and any channels thereof can take a variety of different forms.

In cases where channels CH are provided, one or more (e.g., each) such channels can optionally open all the way through the plate. Alternatively, the plate can have one or more channels that are each open to one or more holes passing entirely through the plate.

When provided, the optional channel or channels CH can be configured to facilitate removing dirt, sand, and the like from between the jaws 300, 305 and the plate 100. This may be accomplished, for example, by spraying the bit breaker 10 with a hose such that dirt, sand, and the like between the jaws 300, 305 and the plate 100 are removed by a stream of water flowing through the channel or channels CH.

Figure 30:
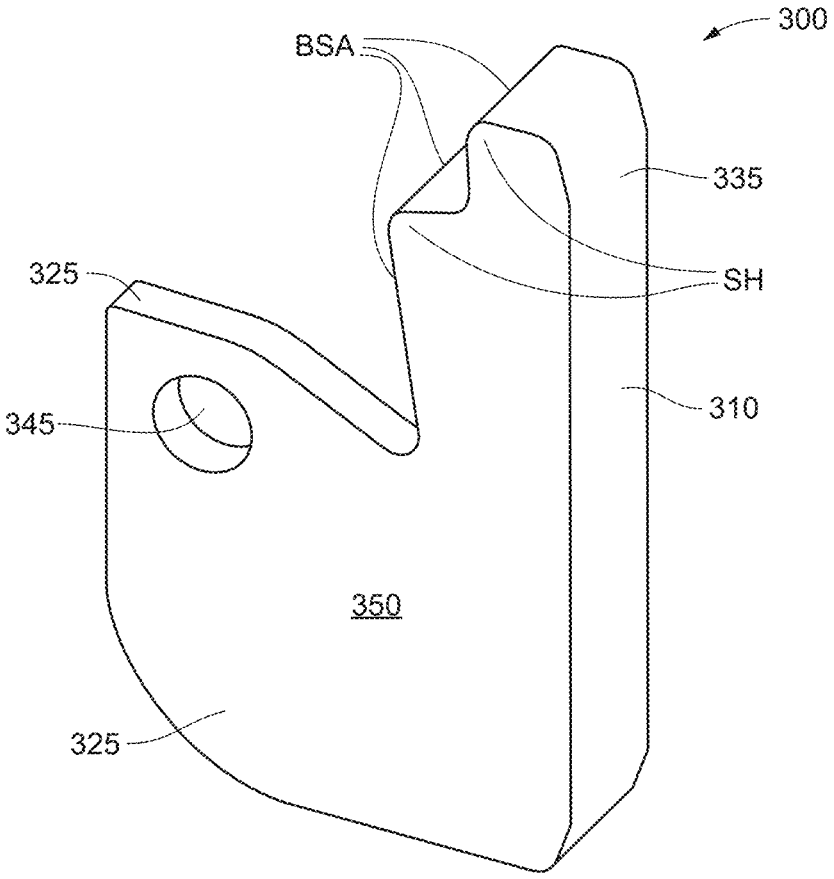
FIG. 30 is a top perspective view of a jaw of the bit breaker of FIG. 21.
Figure 31:
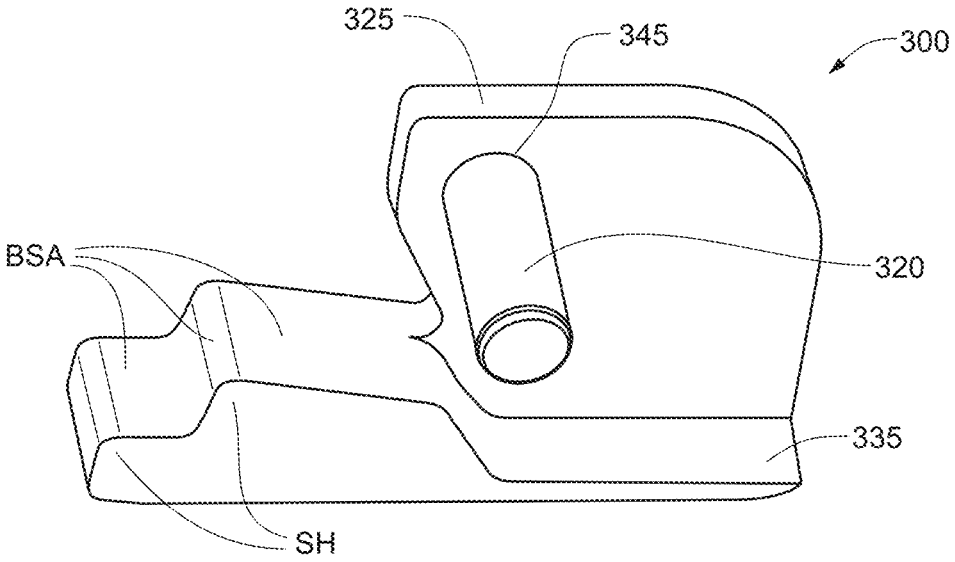
FIG. 31 is a bottom perspective view of the jaw of FIG. 29.

FIGS. 30 and 31 show the details of one non-limiting jaw design. Here, the jaw 300 comprises both a jaw plate 325 and a jaw flange 335. In such cases, each jaw flange 335, 340 may extend away from its respective jaw plate 325, 330, optionally in a generally perpendicular manner. Preferably, the jaw flange 335 has a greater thickness than the jaw plate 325. In FIGS. 30 and 31, the two jaw flanges 335, 340 define the two working surfaces 310, 315 of the bit breaker 310. Thus, the illustrated jaw flanges 335, 340 are exposed to (e.g., bound) the pipe slot 105 when the bit breaker 10 is operatively assembled.

In various jaw designs disclosed herein, each jaw comprises a single body that defines both a jaw plate 325, 330 and a jaw flange 335, 340. In such cases, the jaw plate and jaw flange can optionally be of the nature described above.

In embodiments where each jaw comprises a jaw flange, the jaw flange can optionally define the bearing surface BSA of the jaw. This can be appreciated by referring to FIGS. 30 and 31.

With continued reference to FIGS. 30 and 31, the illustrated jaw 300, and specifically the jaw plate 325 of the illustrated jaw, has one or more apertures 345 formed therein. When provided, each aperture 345 preferably is configured to receive a pin or other fastener 320 for mounting the jaw 300 to a respective connection ledge 130. This can optionally be the case for each jaw 300, 305. In FIG. 31, the illustrated pin 320 has been welded in the above-noted jaw aperture 345. This, however, is not required. For example, the pin can alternatively be welded or otherwise anchored to the plate, and an upper end region of the pin can be received in the jaw aperture with a spring clip or the like provided on the upper end of the pin so as to retain the jaw on the pin such that the jaw can rotate relative to the pin. Many other variants will be obvious to skilled artisans given the present teaching as a guide.

In some cases, one or each of the jaws 300, 305 can comprise an elongated projection, such as a generally finger-like projection. In FIGS. 30 and 31, for example, the jaw flange 335 of the illustrated jaw 300 defines such an elongated projection. When provided, the elongated projection can project from the jaw plate 325. While not required, the elongated projection can generally be shaped like a flipper of a pinball machine.

In the present group of embodiments, each of the two jaws 300, 305 has a working surface 310, 315 and an upper face 350, 355. The upper face 350, 355 of each jaw 300, 305 can optionally be flush or substantially flush with (or at least substantially parallel to) the top face 120 of the plate 100.

FIGS. 32 and 33 schematically illustrate another embodiment wherein the bit breaker 10 has two jaws 300, 305 that are mounted to the plate 100 and are located on opposite sides of the pipe slot 105. Here, the jaws 300, 305 are shaped different than those shown in FIGS. 21-25 and 26-31. Each of the two jaws 300, 305 in FIGS. 32 and 33 has an elongated, generally rectangular configuration. Of course, the generally rectangular configuration is not required. As with the jaws 300, 305 shown in FIGS. 21-25 and 26-31, the jaws 300, 305 shown in FIGS. 32 and 33 have two working surfaces 310, 315, which confront each other across the pipe slot 105. Here again, the two illustrated jaws 300, 305 preferably have two pivot points P that are directly aligned with each other across the pipe slot 105.

Each of the jaws 300, 305 shown in FIGS. 32 and 33 comprises both a jaw plate 325, 330 and a jaw flange 335, 340. As is best shown in FIG. 31, each jaw 300, 305 can optionally have a jaw plate 325, 330 that is symmetrical, or at least generally symmetrical, about a transverse axis extending laterally (i.e., perpendicular to the longitudinal axis LA) through, and passing through a midpoint of the length of, the jaw. In other embodiments, each jaw 300, 305 can optionally have a jaw plate 325, 330 that is asymmetrical about such an axis. Reference is made to FIGS. 21-25 and 26-31, 34-35, and 36-37.

In FIGS. 31 and 32, it can be seen that the two aligned pivot points P are not located at, but rather are spaced from, midpoints of the lengths of the two jaws. Here, each pivot point P is located closer to one end of the jaw than to the other end of the jaw. This can optionally be the case with other pivotable jaw designs shown herein. In some cases, a greater length of one of the jaws (i.e., the jaw 305 shown on the right in FIG. 32) extends from its pivot point P toward the back of the bit breaker than extends from such pivot point toward the front of the bit breaker, whereas a greater length of the other jaw (i.e., the jaw 300 shown on the left in FIG. 32) extends from its pivot point P toward the front of the bit breaker than extends from such pivot point toward the back of the bit breaker (the back of the bit breaker is the side that has the back-end of the pipe slot). This can optionally be the case in the embodiments of FIGS. 21-31, and 34-35 as well.

Turning now to FIGS. 34 and 35, another embodiment of the bit breaker 10 is shown. Here again, the bit breaker 10 has two jaws 300, 305 that are mounted to the plate 100 and are located on opposite sides of the pipe slot 105. These two jaws 300, 305 are shaped different than those shown in previous drawings. In this embodiment, the two jaws 300, 305 are not mirror images of each other. While both of the jaws 300, 305 in this embodiment are pivotally attached to the plate 100, these two jaws have considerably different shapes. For example, the jaw 300 shown on the left in FIG. 34 has two bearing shoulders SH, whereas the jaw 305 shown on the right has only a single bearing shoulder SH. Many other variations will be apparent to those having ordinary skill in this technology area, given the present teaching as a guide.

FIGS. 36 and 37 depict still another embodiment of the bit breaker 10. The two jaws 300, 305 in this embodiment are also mounted to the plate 100 and located on opposite sides of the pipe slot 105. And these two jaws are pivotable relative to the plate. Each of these particular jaws has a step-like bearing surface, and the corresponding mating surface of the plate has a complimentary step-like configuration.

As noted above, to loosen the present joint, the upper component is rotated in a first direction (e.g., counterclockwise), and the bit breaker prevents the lower component from rotating substantially in that direction (e.g., holds the lower component stationary). To make the present joint, the upper component is rotated in a second direction (e.g., clockwise), and the bit breaker prevents the lower component from rotating substantially in that direction (e.g., holds the lower component stationary). In the present embodiment group, this involves the two jaws 300, 305 of the bit breaker 10 moving (e.g., from the release position to the engage position) relative to the plate 100 in response to a pipe, tool section, tool or pipe joint 20 rotating in the pipe slot 105 against the two working surfaces 310, 315 of the two jaws. In more detail, the two jaws 300, 305 preferably move relative to the plate 100 in response to the pipe, tool section, tool or pipe joint 20 rotating in the pipe slot 105 such that flat bottoms of two flat-bottom grooves of the pipe, tool section, tool or pipe joint 20 bear respectively against the two working surfaces 310, 315 of the two jaws. In such cases, the percentages of contact noted previously preferably result. Additionally or alternatively, the movement of the two jaws 300, 305 can optionally include pivoting or otherwise rotating each jaw. Typically, such pivoting or other rotating of the jaws will be rotational movement in a horizontal plane, while the pipe, tool section, tool or pipe joint 20 is vertically disposed. Such movement of the jaws preferably occurs while the plate is maintained in a stationary position (e.g., by virtue of being mounted to a table or another working surface). This can be appreciated by referring to FIG. 17. Thus, in the present method, the bit breaker 10 preferably is mounted on a table or another working surface. In some cases, the working surfaces 310, 315 of the two jaws 300, 305 remain parallel, or at least substantially parallel, to each other during such pivoting or other rotation (or at least end-up being parallel or substantially parallel to each other). Reference is made to the non-limiting release and engage positions shown in FIGS. 24 and 25. Additionally or alternatively, the movement of the jaws relative to the plate can optionally involve a bearing surface BSA of each jaw 300, 305 moving into engagement with (e.g., moving so as to bear against) the corresponding mating surface MSA of the plate 100. This may occur when the method involves loosening a joint. Or, the method may involve a bearing surface BSA of each jaw 300, 305 separating from (e.g., moving apart from) the corresponding mating surface MSA of the plate 100. This may occur when the method involves making a joint. Thus, certain embodiments of the invention provide methods of making, or loosening, the present joint in the manner described above. These methods can involve using a bit breaker in accordance with any embodiment described herein. In any method of the present disclosure, a rotational force of greater than 20,000 foot pounds (e.g., at least about 28,000 foot pounds of torque) can optionally be applied to the pipe, tool section, tool or pipe joint 20.

In embodiments where the method involves a bit breaker having a debris management system of the nature described above, the method can optionally include spraying the bit breaker with water (optionally using a hose) so as to flush dirt or other debris from between the jaws and the plate. This may involve flowing water through one or more channels extending beneath and/or alongside each jaw. Such channels can be of the nature described above.

In any embodiment of the present disclosure, the working surface of the (or each) jaw can optionally have teeth. While certain embodiments mentioned above have no such teeth, other embodiments may benefit from having teeth on the working surface of the (or each) jaw.

Bit breaker components can be fabricated by a combination of cutting (such as flame, plasma, laser or waterjet), bending and/or forming, machining (which includes turning, drilling and milling), and either manual or robotic welding with various metals or composite materials. In addition, some or all the components can also be fabricated using casting, forging or molding in combination with bending and/or forming, machining (which includes turning, drilling and milling), and either manual or robotic welding with various metals or composite materials.

Bit breaker components made from certain metals can be subject to a heat treatment process to increase material hardness or toughness. Various coatings can also be applied to the components through wet or dry process, cold or hot process, electrophoretic process or a basic pickling process.

Thus, embodiments of the invention are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention and the scope of the appended claims.

What is claimed is:

1. A bit breaker comprising a generally flat plate that bounds a generally rectangular pipe slot, the bit breaker further comprising an adjustable arm having a closed position and an open position, wherein when the adjustable arm is in its closed position the pipe slot is surrounded about 360 degrees by the bit breaker, and wherein when the adjustable arm is in its open position the pipe slot has an open side that enables the bit breaker to be removed from a pipe, tool section, tool or pipe joint by moving the bit breaker laterally relative to the pipe, tool section, tool or pipe joint, the bit breaker having two jaws that respectively define two flat working surfaces located on opposite sides of the pipe slot, the two jaws each being mounted removably to the plate of the bit breaker so as to be removable from the plate when damaged and thereafter replaced with two new jaws, wherein the flat working surfaces of the two jaws are each devoid of any concave recess configured to receive a pipe, tool section, tool or pipe joint, and wherein the two jaws are configured to move relative to the plate in response to the pipe, tool section, tool or pipe joint rotating in the pipe slot against the two flat working surfaces of the two jaws.

2. The bit breaker of claim 1 wherein the plate defines two fixed arms and a fixed base leg, the two fixed arms projecting respectively from opposed ends of the fixed base leg, the two fixed arms having two respective free ends to which two opposed ends of the adjustable arm are respectively mounted when the adjustable arm is in its closed position.

3. The bit breaker of claim 2 wherein the plate comprises a single, generally flat body that entirely surrounds three sides of the pipe slot, and when the adjustable arm is in its closed position the adjustable arm bounds the pipe slot on a fourth side thereof.

4. The bit breaker of claim 2 wherein the two jaws are mounted respectively to the two fixed arms, the two fixed arms being non-adjustable such that relative positions of the two fixed arms and the fixed base leg are fixed, and wherein the pipe slot has a width that is non-adjustable in that a distance between the two fixed arms is fixed.

5. The bit breaker of claim 1 wherein the bit breaker is devoid of a manual or powered actuator configured to move the two jaws relative to the plate.

6. The bit breaker of claim 1 wherein the bit breaker has four corners, each of the corners having a pin-locator hole formed therein, and further comprising four replaceable bushings mounted removably in the four respective pin-locator holes.

7. The bit breaker of claim 1 wherein the plate has opposed top and bottom planar faces, the bit breaker further comprising two handles projecting from the top planar face and being located respectively alongside the two jaws, the two jaws being located between the two handles.

8. The bit breaker of claim 1 wherein the plate has opposed top and bottom planar faces, and the plate defines two connection ledges that are recessed from the top face and to which the two jaws are respectively mounted removably, each of the two jaws having an upper face that is substantially flush with the top face of the plate.

9. An assembly of a bit breaker and a pipe, tool section, tool or pipe joint, the pipe, tool section, tool or pipe joint having formed therein two crosswise flat-bottom grooves located on opposite sides of the pipe, tool section, tool or pipe joint, the bit breaker comprising a generally flat plate that bounds a generally rectangular pipe slot, the pipe, tool section, tool or pipe joint being received in the pipe slot, the bit breaker further comprising an adjustable arm having a closed position and an open position, wherein when the arm is in its closed position the pipe slot is surrounded about 360 degrees by the bit breaker, and when the arm is in its open position the pipe slot has an open side that enables the bit breaker to be removed from the pipe, tool section, tool or pipe joint by moving the bit breaker laterally relative to the pipe, tool section, tool or pipe joint, the bit breaker having two jaws that respectively define two flat working surfaces located on opposite sides of the pipe slot, the two jaws being received respectively in the two flat-bottom grooves such that the two flat working surfaces of the two jaws are generally parallel to, and bear respectively against, two flat bottoms of the two flat-bottom grooves, the two jaws each being mounted removably to the plate of the bit breaker so as to be removable from the plate when damaged and thereafter replaced with two new jaws, wherein the two jaws are configured to move relative to the plate in response to the pipe, tool section, tool or pipe joint rotating in the pipe slot against the two flat working surfaces of the two jaws.

10. The assembly of claim 9 wherein the two flat working surfaces of the two jaws respectively contact the two flat bottoms of the two flat-bottom grooves along more than 50% of a length thereof.

11. The assembly of claim 9 wherein the two flat working surfaces of the two jaws are devoid of teeth.

12. The assembly of claim 9 wherein the assembly is devoid of a hydraulic or pneumatic actuator configured to move either of the two jaws.

13. The assembly of claim 9 wherein the plate defines two fixed arms and a fixed base leg, the two fixed arms projecting respectively from opposed ends of the fixed base leg, the two fixed arms having two respective free ends to which two opposed ends of the adjustable arm are respectively mounted when the adjustable arm is in its closed position, the two jaws being mounted respectively to the two fixed arms, the two fixed arms being non-adjustable such that relative positions of the two fixed arms and the fixed base leg are fixed, and the pipe slot having a width that is non-adjustable in that a distance between the two fixed arms is fixed.

14. The assembly of claim 9 wherein the flat working surfaces of the two jaws are each devoid of a concave recess configured to receive a pipe, tool section, tool or pipe joint.

15. The assembly of claim 9 wherein the bit breaker has four corners, each of the corners having a pin-locator hole formed therein, and further comprising four replaceable bushings mounted removably in the four respective pin-locator holes.

16. The assembly of claim 9 wherein the plate has opposed top and bottom planar faces, and the plate defines two connection ledges that are recessed from the top face and to which the two jaws are respectively mounted removably.

17. A bit breaker comprising a generally flat plate that defines two fixed arms and a fixed base leg, the two fixed arms projecting respectively from opposed ends of the fixed base leg, the two fixed arms having two respective free ends, the bit breaker having a generally rectangular pipe slot located between the two fixed arms of the plate, the bit breaker including a jaw mounted to a desired one of the two fixed arms, wherein the jaw defines a working surface located on a side of the pipe slot, the jaw being mounted to the desired one of the two fixed arms so as to be removable therefrom when damaged and thereafter replaced with a new jaw, wherein the plate has opposed top and bottom planar faces, the plate defines a connection ledge that is recessed from the top face and to which the jaw is mounted removably, the jaw having an upper face, the upper face of the jaw being substantially flush with the top face of the plate.

18. The bit breaker of claim 17 wherein the jaw is mounted to the desired one of the two fixed arms such that the jaw has limited freedom to move relative to the desired one of the two fixed arms.

19. The bit breaker of claim 17 wherein the working surface of the jaw is a flat working surface that is devoid of teeth.

20. The bit breaker of claim 17 wherein the pipe slot has a width that is non-adjustable in that a distance between the two fixed arms is fixed.

21. The bit breaker of claim 17 wherein the working surface of the jaw is a flat working surface and is devoid of a concave recess configured to receive a pipe, tool section, tool or pipe joint.

22. The bit breaker of claim 17 wherein the bit breaker is devoid of a hydraulic or pneumatic actuator configured to move the jaw.

23. The bit breaker of claim 17 wherein the bit breaker has four corners, each of the corners having a pin-locator hole formed therein, and further comprising four replaceable bushings mounted removably in the four respective pin-locator holes.

24. The bit breaker of claim 17 further comprising an adjustable arm having a closed position and an open position, wherein when the adjustable arm is in its closed position the pipe slot is surrounded about 360 degrees by the bit breaker, and wherein when the adjustable arm is in its open position the pipe slot has an open side that enables the bit breaker to be removed from a pipe, tool section, tool or pipe joint by moving the bit breaker laterally relative to the pipe, tool section, tool or pipe joint.

25. The bit breaker of claim 17 wherein the bit breaker includes a second jaw, the second jaw mounted to a second one of the two fixed arms, the second jaw defining a working surface located on a side of the pipe slot such that said two jaws are located on opposite sides of the pipe slot, the second jaw being mounted to the second one of the two fixed arms so as to be removable therefrom when damaged and thereafter replaced with a new jaw.

* * * * *